US005947043A

United States Patent [19]

Morita et al.

[11] Patent Number: 5,947,043

[45] Date of Patent: Sep. 7, 1999

[54] SEWING MACHINE HAVING MULTIPLE NEEDLES

[75] Inventors: Tetsuo Morita, Nagoya; Masaki Shimizu, Toyoake; Hirokazu Hirose, Chiryu; Yoshikazu Kurono, Hazu-gun, all of Japan

[73] Assignee: Brother Kogyo Kabushiki Kaisha, Nagoya, Japan

[21] Appl. No.: 08/948,321

[22] Filed: Oct. 10, 1997

[30] Foreign Application Priority Data

Oct. 15, 1996 [JP] Japan ..... 8-272090
Mar. 28, 1997 [JP] Japan ..... 9-077683

[51] Int. Cl.[6] ..... D05B 19/12; D05B 65/00; D05B 69/36

[52] U.S. Cl. ..... 112/102.5; 112/163; 112/273; 112/300; 112/470.04; 112/475.19

[58] Field of Search ..... 112/102.5, 163, 112/164, 165, 166, 167, 300, 470.04, 470.06, 273, 278, 470.05, 155, 475.05, 475.19

[56] References Cited

U.S. PATENT DOCUMENTS 3,709,176 1/1973 Papajewski et al. .
4,077,342 3/1978 Steckenrider .
4,526,114 7/1985 Martell et al. ..... 112/275 X
4,555,997 12/1985 Tancs ..... 112/163 X
4,726,307 2/1988 Yamauchi ..... 112/163 X
5,144,900 9/1992 Takahashi ..... 112/275 X

*Primary Examiner*—Peter Nerbun
*Attorney, Agent, or Firm*—Oliff & Berridge, PLC

[57] ABSTRACT

A sewing machine includes a plurality of needle bars for performing stitching with multiple needle threads. The needle threads have diameters, tenacity, and stretchability different from one another. Sewing parameters inherent to each of the needle threads are beforehand determined. The parameters are maximum sewing speed, thread breakage sensitivity, thread residual amount, needle-rotary hook meet angle, workpiece fabric feed timing, and feed pitch. A spindle motor, a thread cutting motor, a rotary hook drive motor, an X-axis motor, and a Y-axis motor are controlledly driven based on the selected parameters inherent to the just used needle thread.

27 Claims, 13 Drawing Sheets

| | MAXMUM STITCHING SPEED | THREAD CUTTING SENSITIVITY | THREAD RESIDUAL AMOUNT | NEEDLE-ROTARY HOOK MEET ANGLE | FEED TIMING | FEED PITCH |
|---|---|---|---|---|---|---|
| NEEDLE 1 | 1000 | 5 | 5 | 0 | 0 | 0 |
| NEEDLE 2 | 800 | 10 | 7 | 2 | 5 | 1 |
| NEEDLE 3 | 200 | 15 | 5 | −2 | −2 | 2 |
| NEEDLE 4 | 2000 | 10 | 6 | 0 | 1 | 0 |

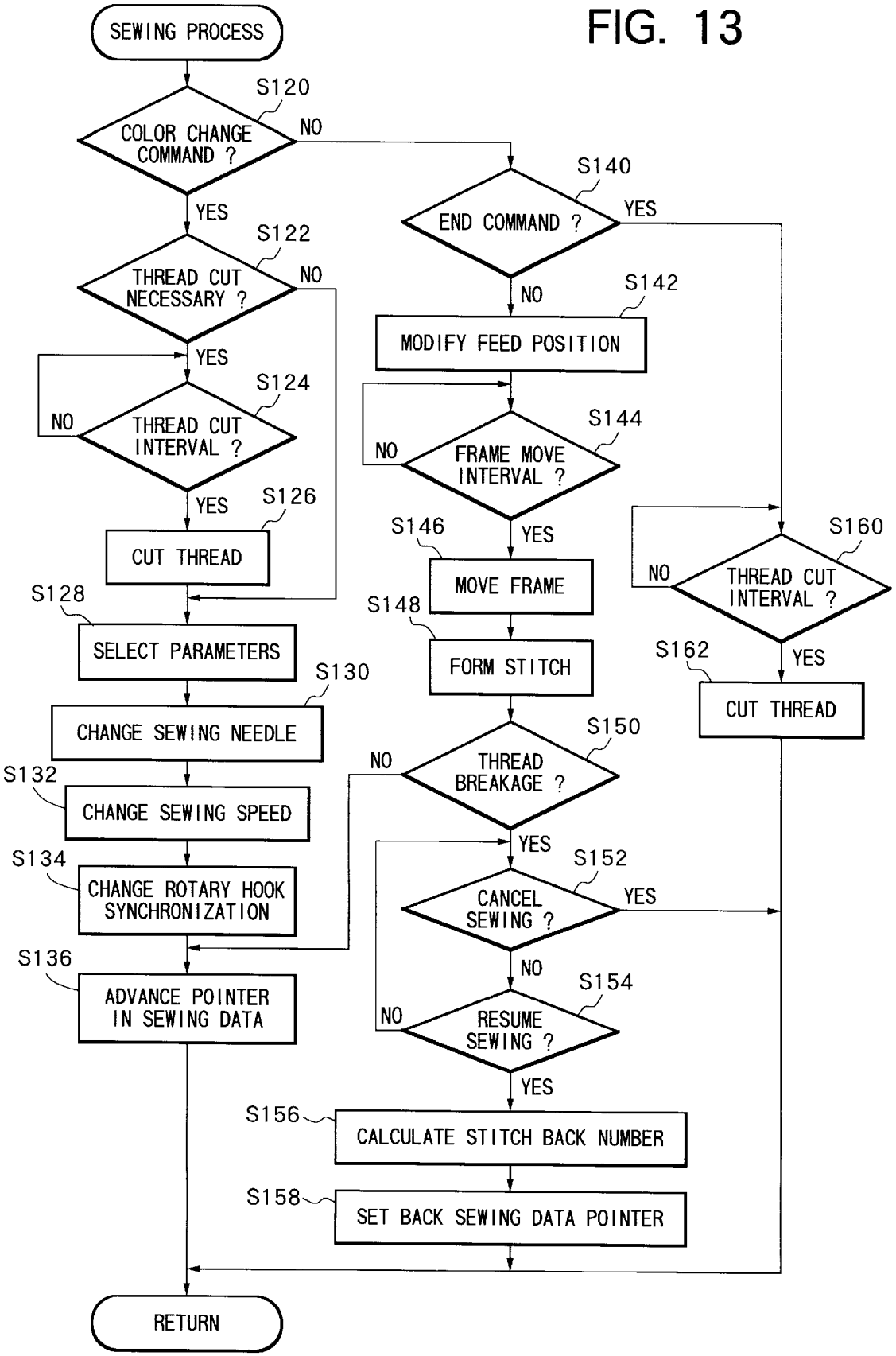
FIG. 13
SEWING PROCESS
S120
COLOR CHANGE COMMAND ?
NO
YES
S122
THREAD CUT NECESSARY ?
NO
YES
S124
THREAD CUT INTERVAL ?
NO
YES
S126
CUT THREAD
S128
SELECT PARAMETERS
S130
CHANGE SEWING NEEDLE
S132
CHANGE SEWING SPEED
S134
CHANGE ROTARY HOOK SYNCHRONIZATION
S136
ADVANCE POINTER IN SEWING DATA
RETURN
S140
END COMMAND ?
YES
NO
S142
MODIFY FEED POSITION
S144
FRAME MOVE INTERVAL ?
NO
YES
S146
MOVE FRAME
S148
FORM STITCH
S150
THREAD BREAKAGE ?
NO
YES
S152
CANCEL SEWING ?
YES
NO
S154
RESUME SEWING ?
NO
YES
S156
CALCULATE STITCH BACK NUMBER
S158
SET BACK SEWING DATA POINTER
S160
THREAD CUT INTERVAL ?
NO
YES
S162
CUT THREAD

SEWING MACHINE HAVING MULTIPLE NEEDLES

BACKGROUND OF THE INVENTION

The present invention relates to a sewing machine having a plurality of sewing needles.

For embroidery stitching with various colors, a plurality of colored threads are used in a sewing machine having multiple needles. In a conventional sewing machine having multiple needles, a plurality of needle bars are vertically movably held by a needle bar case. After moving the needle bar case to move a selected one of the needle bar to a predetermined stitching position, a driving power is transmitted to the selected needle bar from a drive source so that the sewing needle is vertically reciprocatingly driven. By co-operation of the sewing needle and a rotary hook, stitching is performed with using a specified colored thread supplied from a thread spool corresponding to the driving sewing needle.

In such a conventional sewing machine having multiple needles, stitching operation speed, judgment timing for judging occurrence in thread breakage, thread cutting timing by a thread cutting mechanism, the relationship between displacement of the sewing needle and a rotation angle of the rotary hook, the relationship between the displacement of the sewing needle and a timing for feeding a workpiece fabric, and a feeding amount of the workpiece fabric are not adjustable. In another conventional sewing machine having multiple needles, these may be adjustable. However, the adjustment is imparted uniformly on all sewing needles.

However, the plurality of needle threads those used in the sewing machine having multiple needles have characteristic different from one another dependent on materials, diameters, and stranding manner, and therefore, tensile strength, stretching and shrinking characteristic and surface smoothness are different from each of the needle threads. Accordingly, even if adjustment is given so as to provide optimum sewing condition with respect to a specific one of the needle threads, this adjustment is also imparted on the other sewing needle, and therefore, this adjustment is not proper to the needle threads associated with the other sewing needles.

To be more specific, provided that operation speed of the sewing needles are evenly adjusted on the premise of a needle thread having an average characteristic, thread cutting may frequently occur if a needle thread having an extremely low tensile strength is also used in one of the sewing needles. To avoid this, if the operation speed of the sewing needles is evenly adjusted with respect to the all sewing needles on the premise of a needle thread having the lowest tensile strength, entire sewing needle are operated at lower speed. This lowers sewing efficiency.

Further, in this type of sewing machine having multiple needles, a thread cutting sensor is provided for making judgment of the cutting or breakage of the needle thread. The thread cutting sensor is provided by a rotation member rotated in frictional contact with the needle thread paying out from the thread spool and a detector such as a photosensor for detecting the rotation state of the rotation member. With this arrangement, occurrence in thread cutting is detected if the rotation member is not rotated in spite of a predetermined numbers of vertically reciprocating movement of the sewing needle. In this case, even if adjustment is made so as to detect the cutting of the thread at a proper timing with respect to a needle thread having an average characteristic, the rotation member may not be rotated in spite of the paying out of the needle thread due to the slippage of the needle thread over the rotation member if the needle thread has a relatively low friction coefficient. As a result, judgment may erroneously fall that the thread breakage occurs in spite of no occurrence of thread cutting.

Reversely, judgment timing for judging the occurrence in thread cutting can be delayed taking such needle thread having the relatively low friction coefficient into consideration. However, judgment timing as to the whole sewing needles are evenly delayed. Accordingly, occurrence in thread cutting cannot be promptly judged with respect to the needle thread having an average characteristic.

Further, in the conventional sewing machine having multiple needles, the needle thread and the bobbin thread are cut by a thread cutting mechanism provided in the machine when a consequential sewing operation is completed. By adjusting operation timing of the thread cutting mechanism, a remaining or residual length of the thread extending from a needle hole through which the thread passes to a cut end of the thread can be changed. Even if the operation timing is adjusted so as to provide an optimum remaining length with respect to the thread having an average characteristic, the desired remaining length cannot be obtained with respect to a thread having a shrinking nature. That is, such largely shrinkable thread shrinks immediately after the thread cutting operation. In some cases, the largely shrinkable thread may be disengaged from the thread hole due to its excessive shrinkage.

Reversely, the thread cutting mechanism can be operated at a proper timing so as to obtain sufficient remaining length of the thread taking the largely shrinkable thread into consideration. However, this adjustment is effected to all sewing needles, and therefore, excessively large remaining length may be provided in case of the thread having an average shrinking characteristic. Such a large remaining length portion of the thread may be involved in a stitch seam, or entangled with a movable component.

Further in the conventional sewing machine having multiple needles, rotation phase of a rotary hook (loop taker) is adjusted in such a manner that a loop seizing beak of the rotary hook reaches a thread trapping position at a needle-rotary hook meet timing when the needle is slightly moved upwardly after the needle is moved to its lower dead center. In this case, a sufficient size of thread loop can be formed and the thread can be trapped by the loop seizing beak at the adjusted rotational phase with respect to the thread having an average characteristic. However, if a largely distortable thread is also used, a resultant loop may be distorted when the loop is growing large. With such a distorted shape of the loop, the thread is not easily trapped by the loop seizing beak.

In order to avoid this problem, a rotational phase adjustment of the rotary hook can be made so as to trap the thread while the loop is not grown so large and the large distortion of the loop has not occurred taking the largely distortable thread into consideration. However, since this adjustment is effected on all sewing needles, rotation phase of the all rotary hooks is also evenly changed. Accordingly, loop trapping may become difficult in accordance with the smaller size in the loop in case of the thread having an average distortional characteristic.

Further, conventionally, the feed of the workpiece fabric is adjusted with respect to the all sewing needles regardless of the feeding amount or distance such that the feed is started when the sewing needle is elevated to a predetermined position, and feed is terminated when the needle is moved downwardly to a predetermined position. Further, the feeding is performed by a predetermined amount or distance provisionally set. However, in spite of the feed with respect to the all needles under the even condition with each other, actual seam size and tension of the stitched thread may be different from one another due to difference in characteristics of the threads and difference in tensions applied to the threads. Furthermore, even if constant seam and tension are provided in all stitches, users may have mistaking visual impression that the seams and tensions are different from each of the threads due to the difference in diameters and colors of the threads. Such differences cannot be reduced by the even adjustment of the fabric feed timing and feed amount with respect to all stitches.

SUMMARY OF THE INVENTION

It is therefore an object of the present invention to provide a sewing machine having multiple needles capable of providing optimum stitching condition independent of each needle or needle threads.

This and other objects of the present invention will be attained by a sewing machine including a plurality of sewing needles securing needle threads, a selected one of the sewing needles being driven in accordance with a sewing program, parameter setting means, parameter storage means, parameter selection means, and sewing control means. The parameter setting means is adapted for setting a plurality of parameters each defining operating condition of at least one sewing machine component, each parameter being set for each sewing needle. The parameter storage means is adapted for storing the parameters set by the parameter setting means for each sewing needle. The parameter selection means is adapted for selecting one of the parameters corresponding to the selected one of the sewing needles among the parameters in the parameter storage means. The sewing control means is adapted for controlling the at least one sewing machine component in order to perform sewing operation based on the parameter selected by the parameter selection means.

In another aspect of the invention, there is provided a sewing machine for stitching a workpiece fabric with a needle thread and a bobbin thread comprising a plurality of needle bars each securing a sewing needle, each sewing needle securing a needle thread different from each other, each needle thread being paid out from each thread spool to each sewing needle, a sewing machine motor, a spindle rotatingly driven by the sewing machine motor, means for connecting the spindle to a selected one of the needle bars so as to veritically reciprocatingly drive the selected needle bar carrying a desired needle thread, a rotary hook having a loop seizing beak, a stitch being formed by cooperation of the sewing needle and the rotary hook, a rotary hook drive motor for rotatingly driving the rotary hook, a thread cutting mechanism including a thread cutting motor and a blade driven by the thread cutting motor for cutting the needle thread and the bobbin thread, a thread cutting sensor for detecting pay-out of the thread from the thread spool, a workpiece fabric feeding mechanism including a movable holder at which the workpiece fabric is held, an X-axis motor connected to the movable holder for moving the movable holder in X-direction and a Y-axis motor connected to the movable holder for moving the movable holder in Y-direction, parameter setting means for setting a plurality of parameters each defining operating condition of at least one of the sewing machine motor, the rotary hook drive motor, the thread cutting motor, the X-axis motor and the Y-axis motor, each parameter being set for each sewing needle, parameter storage means for storing the parameters set by the parameter setting means for each sewing needle, parameter selection means for selecting one of the parameters corresponding to the selected one of the sewing needles among the parameters in the parameter storage means, and sewing control means for controlling the at least one of the sewing machine motor, the rotary hook drive motor, the thread cutting motor, the X-axis motor and Y-axis motor in order to perform sewing operation based on the parameter selected by the parameter selection means.

In still another aspect of the invention, there is provided a method for performing different sewing operation mode in accordance with a difference in kind of needle threads secured by a plurality of sewing needles in a sewing machine having the plurality of sewing needles, the sewing needles being consecutively selected and operated for performing stitching with different kind of threads, the method comprising the steps of provisionally setting parameters inherent to each sewing needles, the parameters being in correspondence with the threads of the sewing needles, storing the set parameters in a storage means with making correspondence of each parameter with each sewing needle, making judgment as to which one of the sewing needles is to be operated for sewing, selecting the parameters associated with the sewing needle to be operated from the storage means, and performing sewing operation and thread cutting operation based on the selected parameters.

BRIEF DESCRIPTION OF THE DRAWINGS

In the drawings:

FIG. 13 is a flowchart showing a sewing control routine according to the embodiment;

DETAILED DESCRIPTION OF THE PREFERRED EMBODIMENTS

A sewing machine having multiple needles according to one embodiment of the present invention will be described with reference to accompanying drawings.

Figure 1:
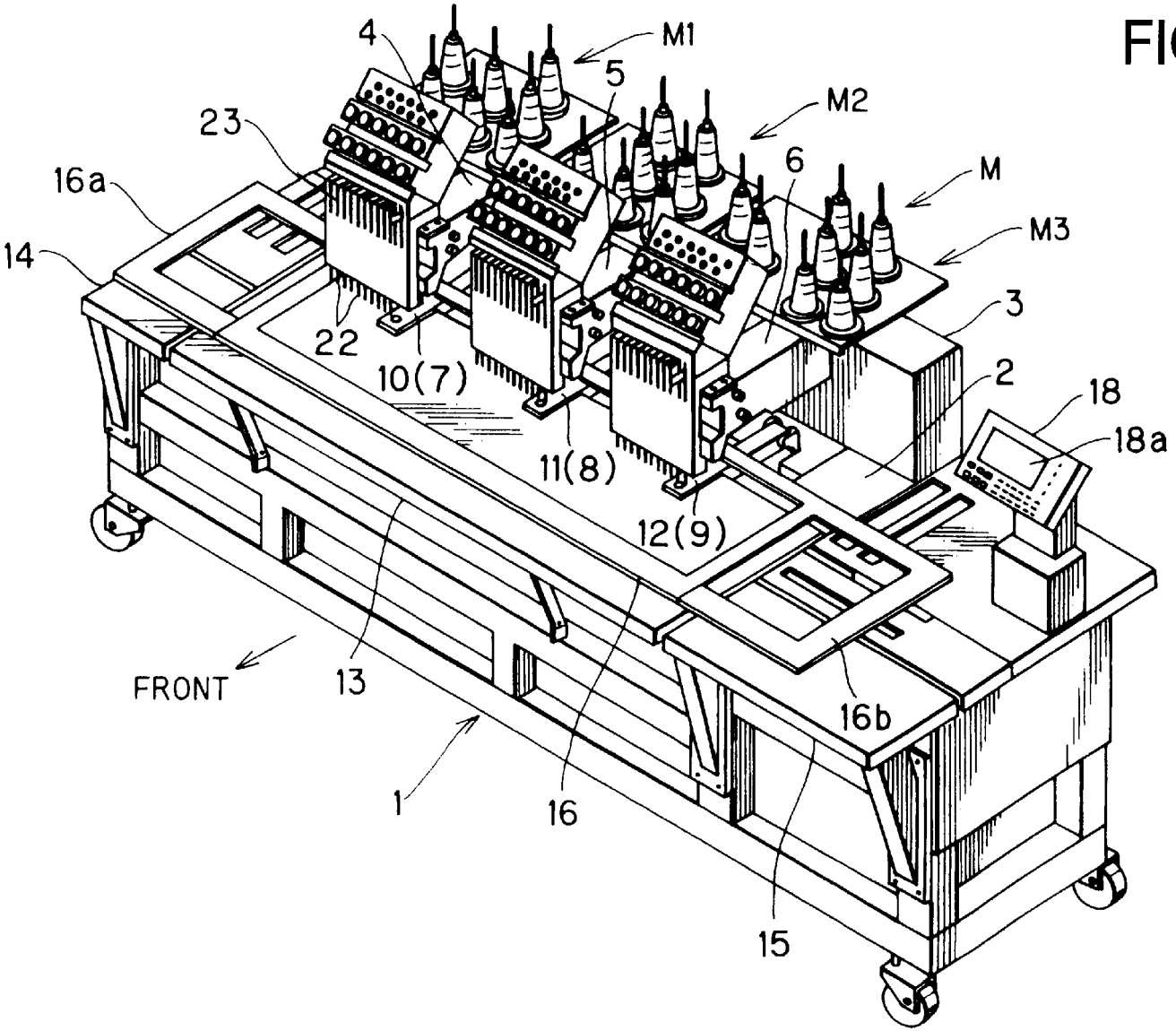
FIG. 1 is a perspective view showing a multiple head type sewing machine having multiple needles according to one embodiment of the present invention.

As shown in FIG. 1, the embodiment concerns a multiple head type embroidery machine M in which three embroidery sewing machines M1, M2, M3 each having a plurality of sewing needles are juxtaposedly arrayed in a lateral direction.

As shown in FIG. 1, the multiple head type embroidery machine M includes a laterally extending base frame 1. The base frame 1 has an upper rear surface provided with a laterally extending sewing machine supporting plate 2 having a rectangular shape in a plan view. Further, a laterally extending support frame 3 upstands from a rear portion of the sewing machine supporting plate 2. On the support frame 3, three head portions 4 through 6 are juxtaposed side by side with a predetermined space therebetween. On the base frame 1 and at a position in front of the sewing machine supporting plate 2, each rear end portion of bed 7, 8, 9 constituted in each bed unit 10, 11, 12 are supported at a position corresponding to the head portions 4, 5, 6, respectively. Thus, three multiple needle type embroidery machine M1, M2, M3 are provided by the head portions 4, 5, 6 provided on the support frame 3 and corresponding bed units 10, 11, 12 in a side by side relation. Each head portion 4, 5, 6 are mechanically independent of each corresponding bed unit 10, 11, 12, and bed units 10,11,12 are mechanically independent of one another.

At each front end portion of each head portion 4,5,6 of each multiple needle type embroidery machine M1, M2, M3, a needle bar case 20 is laterally movably supported. In each needle bar case 20, twelve needles 21 arrayed in the lateral direction are vertically movably supported and twelve thread take-up levers 23(see FIG. 1) are pivotably movably supported. These needle bar cases 20 are concurrently moved laterally by a needle bar changing mechanism (not shown) driven by a needle bar changing motor 115 (FIG. 9) in order to concurrently change color of the threads for the embroidery stitching.

A work table 13 extends in a horizontal direction at a position in front of the sewing machine supporting plate 2. The height of the work table 13 can be changed, and can be co-incident with the height of an upper surface of the bed units 10, 11, 12. A pair of auxiliary tables 14, 15 are provided at lateral ends of the work table 13. Further, a movable frame 16 having a rectangular shape and extending in the lateral direction is mounted on the pair of auxiliary tables 14, 15 and on the work table 13.

Figure 9:
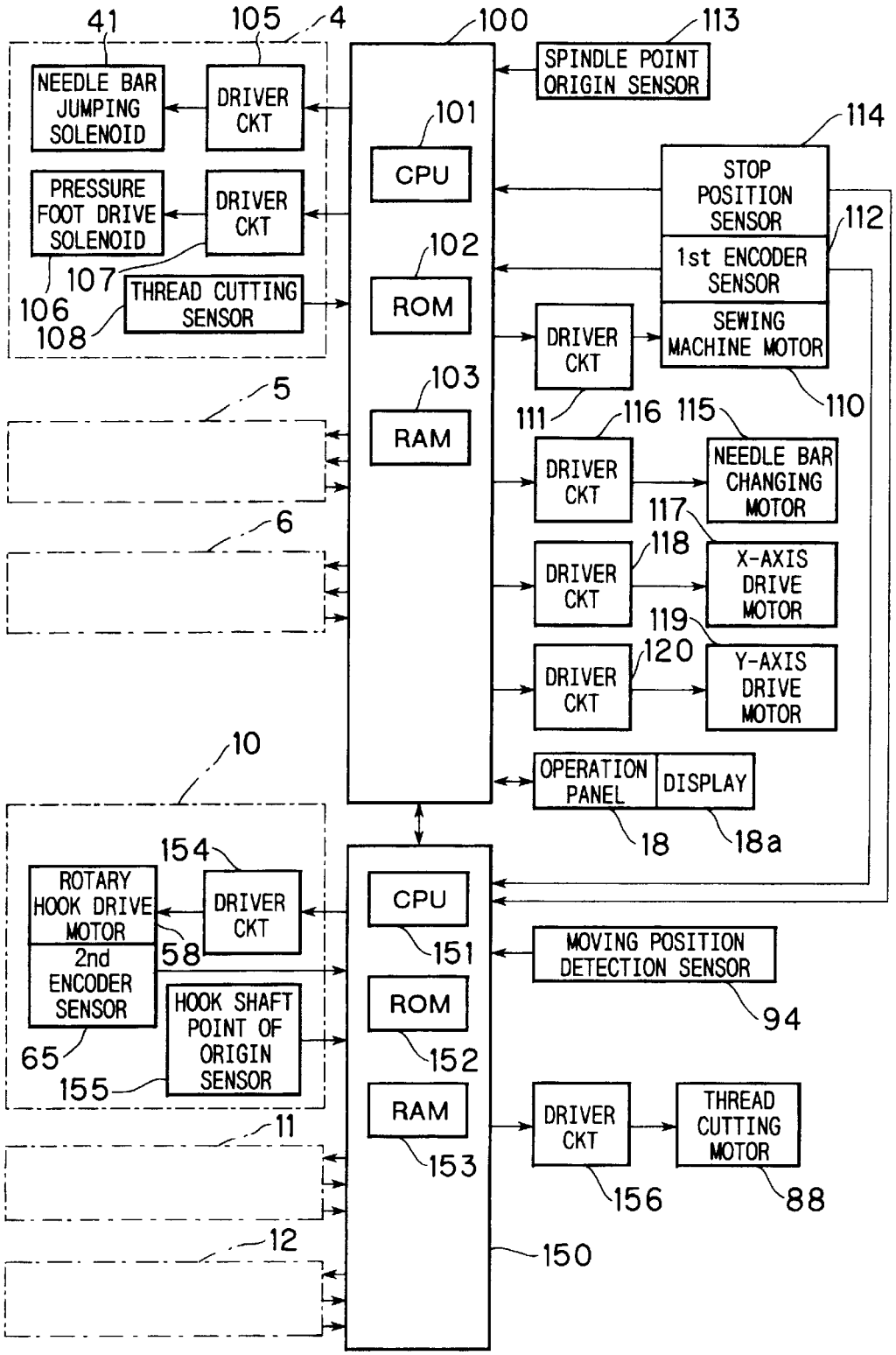
FIG. 9 is a block diagram showing a control system of the sewing machine having multiple needles according to the embodiment.

The movable frame 16 has a left end portion serving as a driving frame portion 16a which is movable in an X-axis direction, i.e., the lateral direction (rightwardly and leftwardly in FIG. 1) by an X-axis drive mechanism (not shown). Further, the movable frame 16 has a right end portion serving as another driving frame portion 16*b*. These driving frame portions 16*a* and 16*b* are movable in a Y-axis direction( frontwardly and rearwardly in FIG. 1) by a Y-axis drive mechanism (not shown). Accordingly, the movable frame 16 is movable in a X-Y plane by the X-axis drive mechanism driven by an X-axis drive motor 117 (FIG. 9) and the Y-axis drive mechanism driven by a Y-axis drive motor 119 (FIG. 9).

Further, at the rear side of the auxiliary table 15, an operation panel 18 is provided for inputting various commands. The operation panel 18 includes a display 18*a* for displaying a message in connection with the embroidery stitching. Further, the operation panel 18 has a parameter setting key (not shown) for setting parameters with respect to each sewing needle. The parameter setting will be described later. The operation panel also includes a start sewing key (not shown) for starting sewing operation, an end sewing key (not shown) for ending the sewing operation, a cancel sewing key (not shown) for temporarily stopping the sewing operation, and a resume key (not shown) for re-starting the sewing operation.

Next, a needle bar driving mechanism 25 for vertically moving needle bars 21 will be described with reference to FIG. 2. The needle bar driving mechanism 25 is provided in each of the embroidery machines M1, M2, M3. At the front end portion of each of the head portions 4, 5, 6, a master needle bar 26 extending in the vertical direction is provided. Upper and lower end portions of the master needle bar 26 is supported to a frame (not shown) of the needle bar case 20. A vertically movable segment 27 is movably supported to and around the master needle bar 26. The movable segment 27 is formed with an engagement groove 27*a* engageable with a linking pin 34 described later. The movable segment 27 has a lower end portion provided with a needle bar embracing segment 28 which is vertically movable and unrotatable relative to the master needle bar 26. The needle bar embracing segment 28 is connected to a link 31 pivotally connected to a swing lever 30 pivotably supported about a pivot shaft 29. The movable segment 27 is rotatable with respect to the needle bar embracing segment 28.

A single sewing machine spindle 17 extends in the lateral direction through the head portions 4, 5 and 6. The spindle 17 is driven by a sewing machine motor 110 (FIG. 9). An eccentric cam 32 is fixedly mounted on the spindle 17, and an eccentric lever 33 is disposed over he eccentric cam 32. The eccentric lever 33 has a lower end pivotally connected to the swing lever 30.

Each lower end portion of each of the twelve needle bars 21 is provided with a sewing needle 22, and each needle bar 21 has an intermediate portion fixed with the linking pin 34. A compression spring 35 is disposed around the needle bar 21 and interposed between the linking pin 34 and the support frame of the needle bar case 20, so that the needle bar 21 is urged to its upper needle position by the biasing force of the compression spring 35. Further, each one of the linking pins 34 of each one of the needle bars 21 confronting the vertically movable segment 27 can be selectively engaged with the engagement groove 27*a* of the vertically movable segment 27 when the needle bar case 20 is moved in the lateral direction.

With this arrangement, upon rotation of the sewing machine motor 110 (FIG. 9) in a predetermined rotational direction, the spindle 17 is rotated about its axis, so that the vertically movable segment 27 and the needle bar embracing segment 28 are integrally reciprocally moved in the vertical direction by way of the eccentric lever 33, the swing lever 30 and the link 31. As a result, only one of the needle bars 21 engaging with the vertically movable segment 27 through the linking pin 34 is vertically reciprocally moved in timed relation with the rotation of the spindle 17.

Next a needle bar jumping mechanism 40 will be described with reference to FIG. 2. This mechanism 40 is provided in each of the embroidery machines M1, M2, M3 and is adapted to jump the needle bar 21 to its uppermost position or upper dead point.

Within the needle bar case 20, a needle bar jumping solenoid 41 is provided. The solenoid 41 has a plunger extending in the horizontal direction. Further, an angularly movable L-shaped lever 42 is provided in the needle bar case 20. The L-shaped lever 42 has a L-shape configuration as viewed in a plan view, and is pivotable about a vertical axis. The L-shaped lever 42 has a drive portion 42*a* abuttable on an end of the plunger of the solenoid 41. The L-shaped lever 42 has a driven portion 42*b* provided with an operation shaft 43 extending in the vertical direction. The above described vertically movable segment 27 integrally provides a protruding engaging portion 27A, and the operation shaft 43 is engageable with the engaging portion 27A.

Further, a torsion coil spring 44 is connected to an upper end portion of the vertically movable segment 27 so as to normally urge the vertically movable segment 27 to its linking position shown by a solid line where the linking pin 34 is engaged with the engagement groove 27*a*. Incidentally, a two dotted chain line indicates a jumping position of the vertically movable segment 27 as a result of counterclockwise rotation of the vertically movable segment 27.

Figure 2:
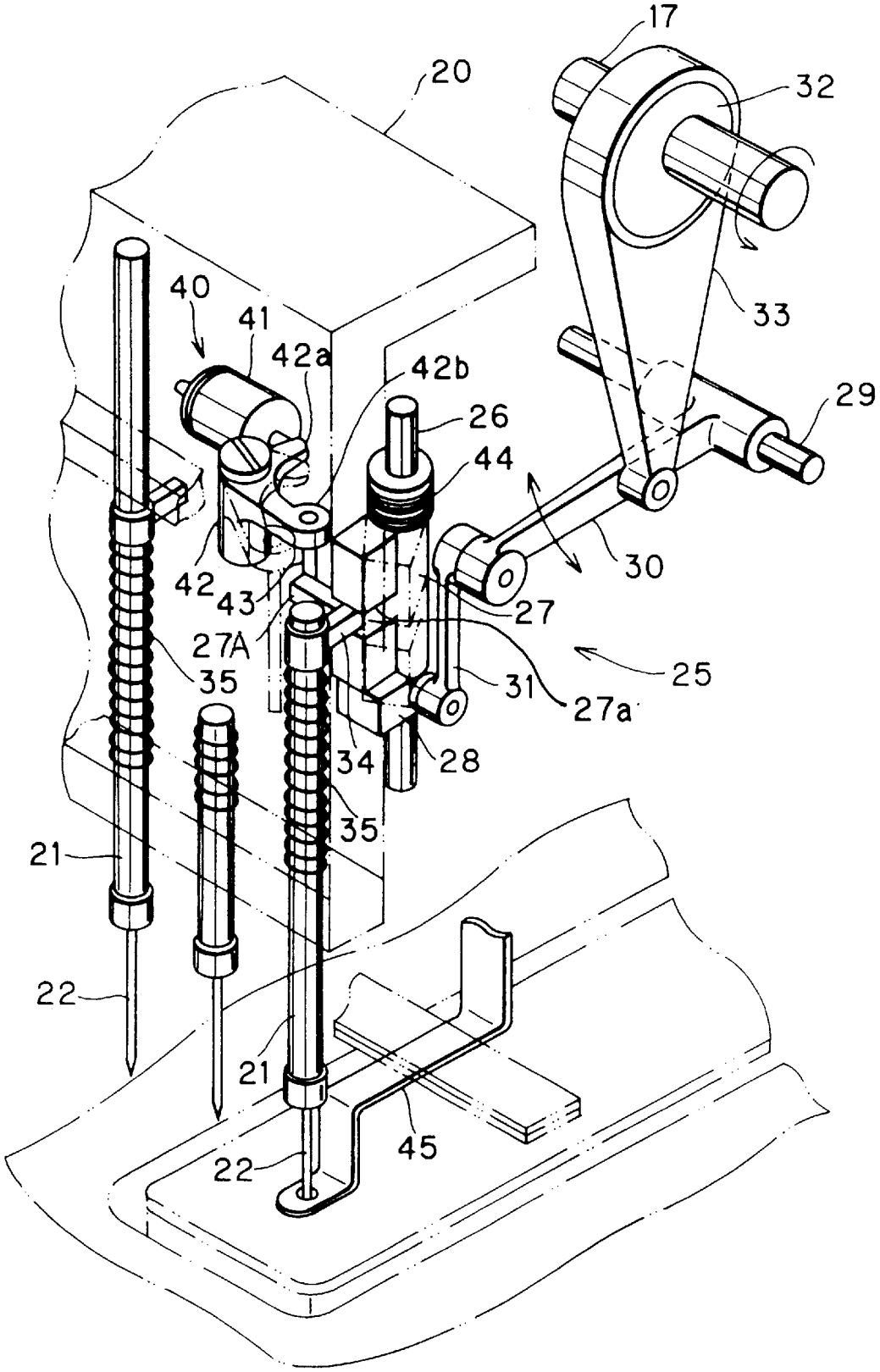
FIG. 2 is a schematic perspective view showing a needle bar vertical moving mechanism including a needle bar jumping mechanism according to the embodiment.

With this structure, if the needle bar jumping solenoid 41 is actuated for a predetermined period to extend its plunger rightwardly in FIG. 2 when the needle bar 21 is connected to the vertically movable segment 27 by way of the linking pin 34, the pivotable lever 42 is angularly moved in a clockwise direction in FIG. 2. Therefore, the operation shaft 43 pushes the protruding engaging direction in the counterclockwise direction in FIG. 2. Thus, the vertically movable segment 27 is pivotally moved to the jumping position indicated by the two-dotted chain line against the biasing force of the coil spring 44. Consequently, the linking pin 34 is disengaged from the engagement groove 27*a*, and at the same time, the needle bar 21 is promptly moved to its uppermost position, i.e., the needle bar 21 performs the jumping operation by the biasing force of the compression spring 35.

On the other hand, if the vertically movable segment 27 is moving upwardly from its lower position to its uppermost position in a state where the needle bar 21 has the uppermost position as a result of the jumping operation while the vertically movable segment 27 restores its angular linking position, the vertically movable segment 27 is firstly brought into abutment with the lower surface of the linking pin 34, and is temporarily pivotally moved about the master needle bar 26 to the angular jump position indicated by the two dotted chain line. However, because of the biasing force of the coil spring 44, the vertically movable segment 27 is promptly angularly moved back to its angular linking position indicated by the solid line, so that the linking pin 34 can be automatically brought into engagement with the engagement groove 27*a*.

Incidentally, each of the bed portions 7, 8, 9 is provided with a pressure foot 45. The position of the pressure foot 45 can be changed between a pressing position where the pressure foot 45 depresses a workpiece fabric W on the associated bed portion 7, 8, 9 and a retracting position positioned above the pressure position by a predetermined distance. A pressure foot drive mechanism (not shown) is provided including a pressure foot drive solenoid 106 (FIG. 9) for changing the position of the pressure foot 45.

Next, the bed units 10, 11, 12 will be described with reference to FIGS. 3 through 8. These bed units are identical with one another, and therefore, description will be made on the leftmost bed unit 10 only.

Figure 3:
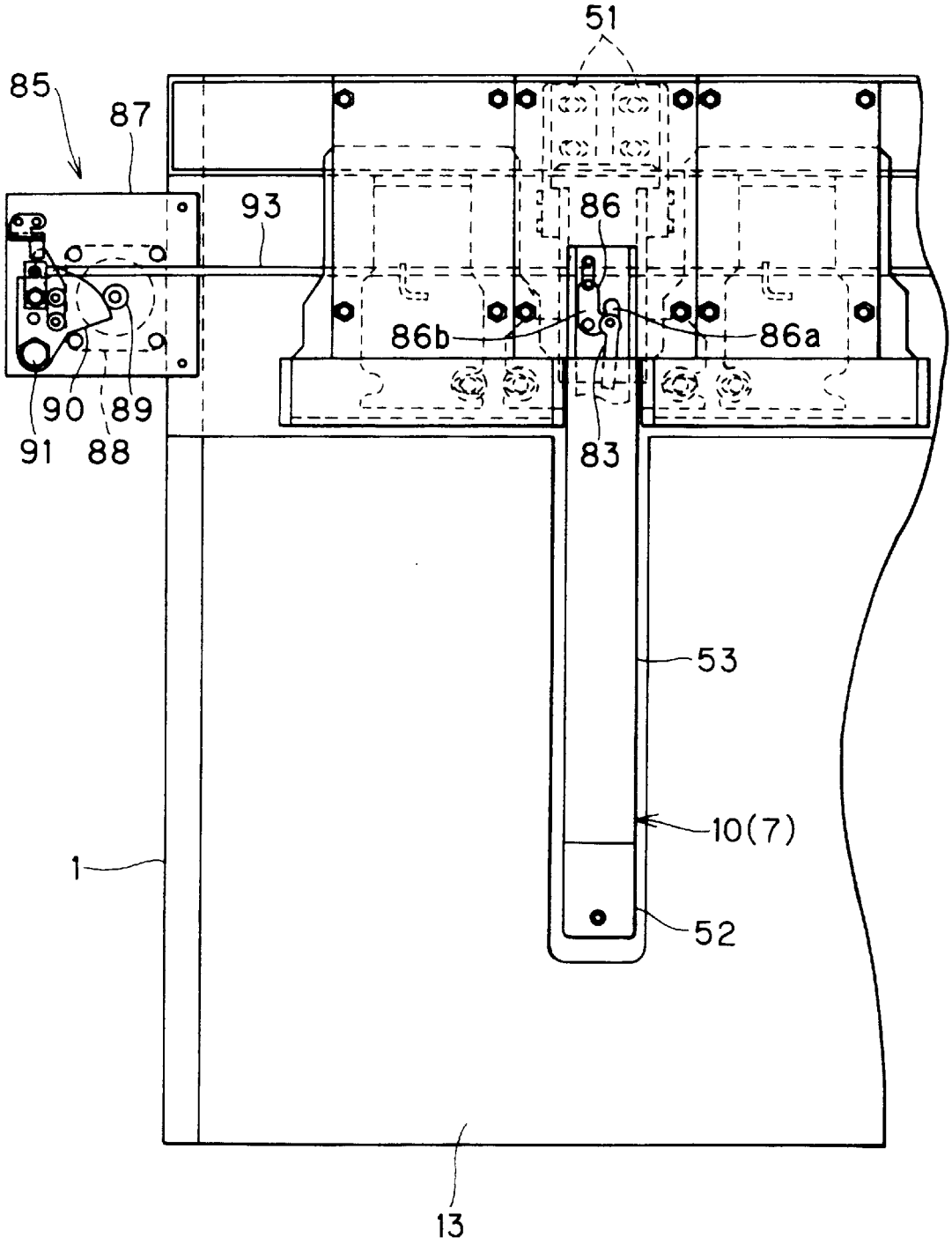
FIG. 3 is a plan view showing an essential portion of a work table and a bed unit according to the embodiment.

A bed case 50 having a substantially U-shape cross-section extends in the frontward/backward direction. The rear end of the bed case 50 is fixed to a pair of support brackets 51 fixedly secured to the base frame 1 positioned at a front end portion of the sewing machine support plate 2 and extending in the transverse direction. The front portion of the bed case 50 is detachably provided with a rotary hook module 55. As best shown in FIG. 3, the upper front portion of the bed case 50 is covered with the throat plate 52 and the remaining upper side of the bed case 50 is covered with a cover plate 53 provided continuously with the throat plate 51.

Figure 4:
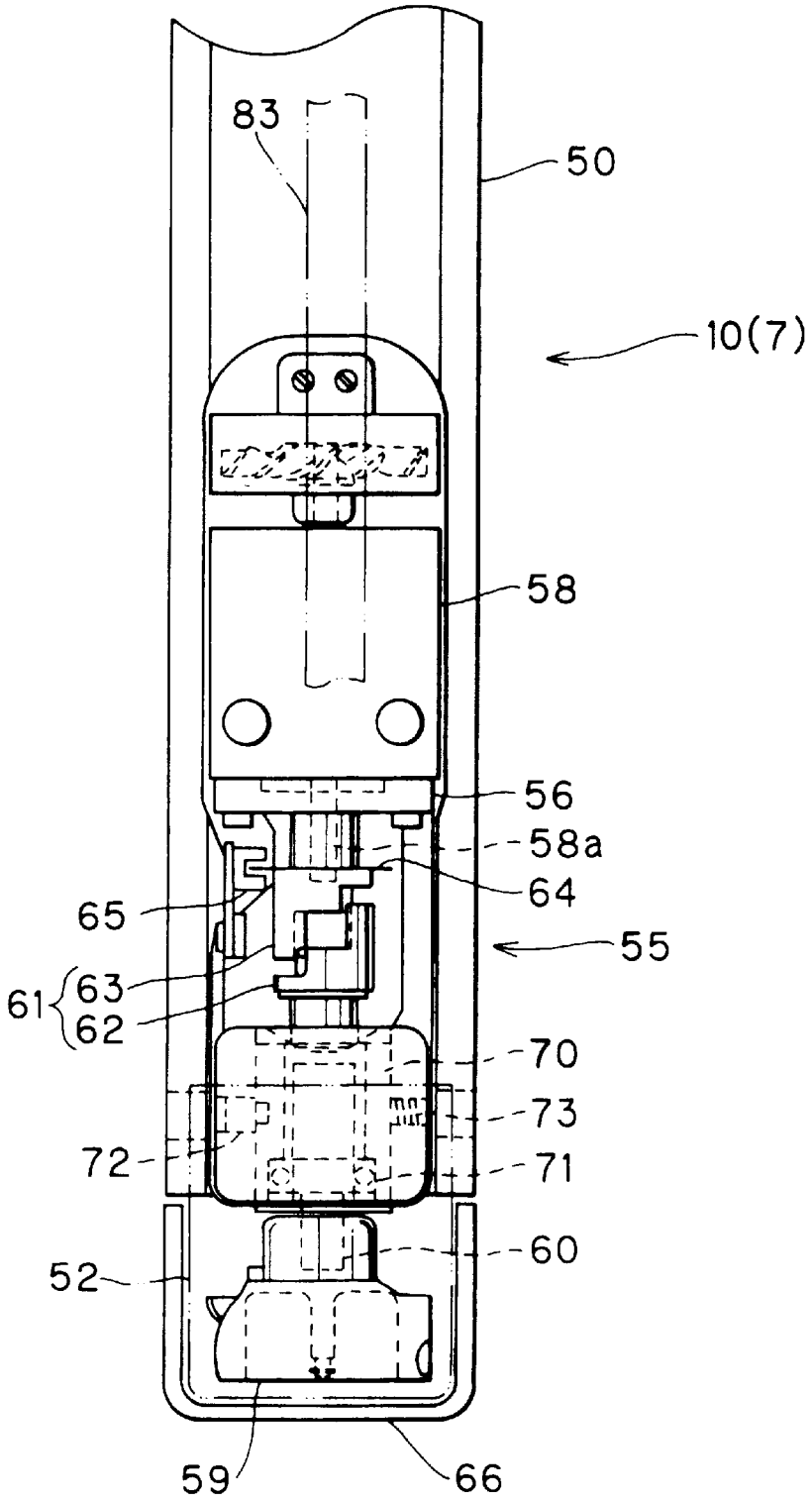
FIG. 4 is a plan view showing a part of the bed unit provided with a rotary hook module according to the embodiment.
Figure 5:
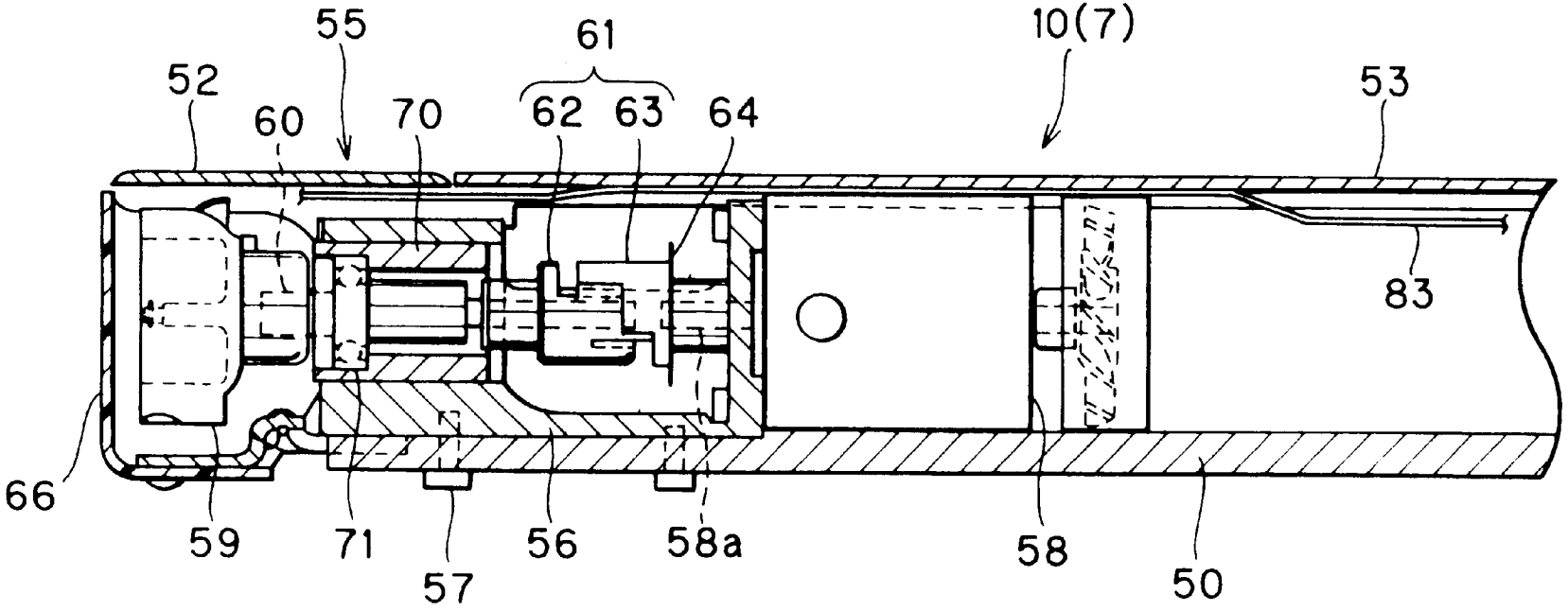
FIG. 5 is a vertical cross-sectional view showing the part of the bed unit provided with the rotary hook module according to the embodiment.

Next, the rotary hook module 55 will be described with reference to FIGS. 4 through 6. An attachment block 56 is detachably fixed to a front end portion of the bed case 50 by screws 57. Further, a rotary hook drive motor 58 such as a stepping motor is attached to a rear end portion of the attachment block 56. The rotary hook drive motor 58 has a drive shaft 58*a*. On the other hand, a rotary hook or a loop taker 59 for trapping a thread loop is provided at a front end portion of the attachment block 56. The rotary hook 59 includes a hook shaft 60 movably frontwardly/backwardly and rotatably supported by the attachment block 56. The hook shaft 60 has a rear end portion fixed with a first coupling member 62. The drive shaft 58*a* of the drive motor 58 has a front end portion fixed with a second coupling member 63. The first and second coupling members 62 and 63 are coupled together, to provide a coupling 61. Thus, the hook shaft 60 and the drive shaft 58*a* are coupled together by the coupling 61.

Figure 6:
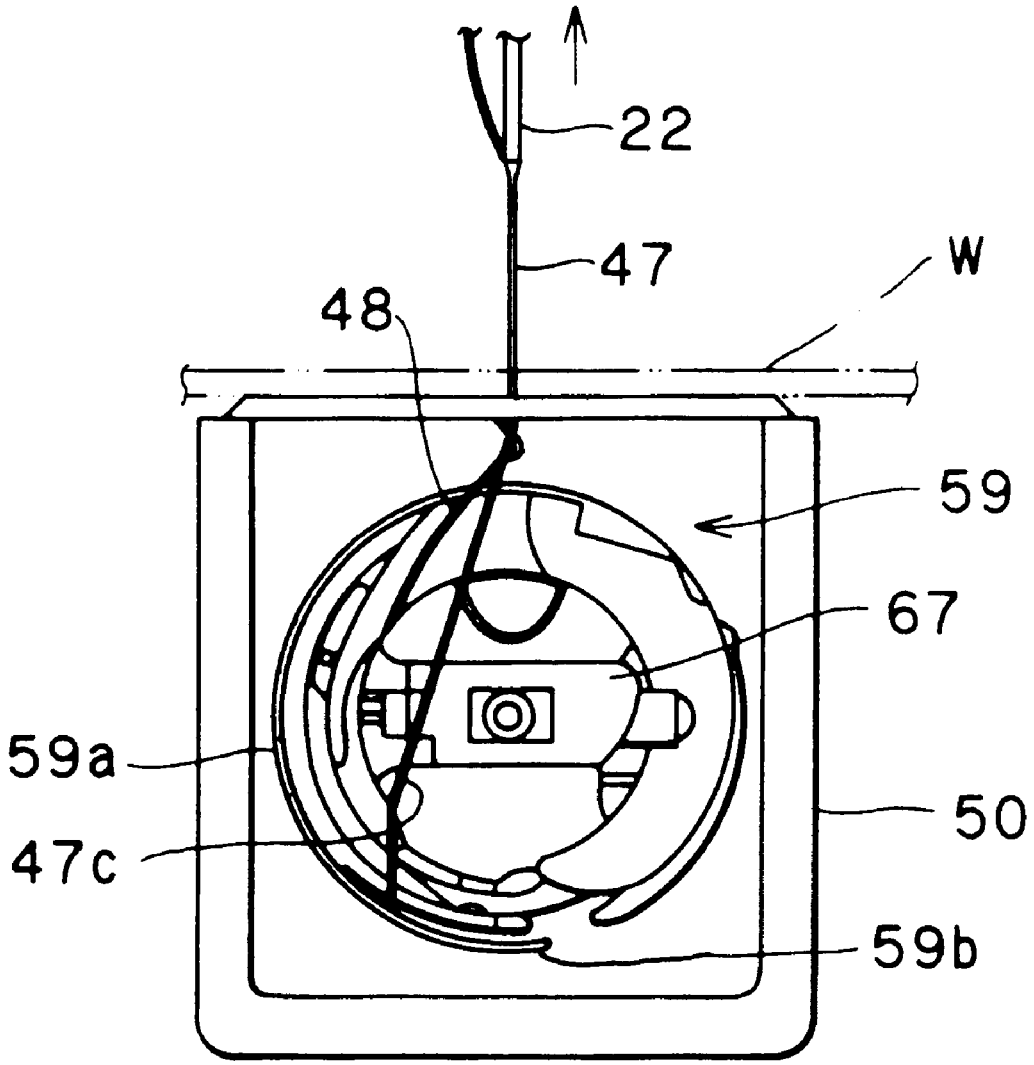
FIG. 6 is a front view showing the rotary hook when the spindle is at its rotation angle of about 300° according to the embodiment.

The rotary hook 59 is best shown in FIG. 6. The rotary hook 59 includes an inner rotary hook or a bobbin case carrier element accommodating therein a bobbin case 67 in which a bobbin is accommodated, and an outer rotary hook or a hook body 59*a* rotatable around the inner rotary hook. The outer rotary hook 59*a* has a loop seizing beak 59*b* for hooking a needle thread 47 and forming the needle thread loop 47*c*. A needle and rotary hook meet timing (FIG. 15) is defined when the loop seizing beak 59*b* intersects the thread hole or eyelet of the sewing needle 22 when the spindle 17 is rotated about 200°. At the needle and rotary hook meet position, the loop seizing beak 59*b* hooks the needle thread 47 extending through the thread hole of the needle 22, and forms the loop 47*c* moving between the inner rotary hook and the outer rotary hook 59*a* upon rotation of the outer rotary hook 59*a*.

Further, the second coupling member 63 is provided with a disc encoder 64 formed with a plurality of slits. A second encoder sensor 65 such as a photosensor is attached to the attachment block 56 for optically detecting the plurality of slits and generating a hook shaft rotation signal. Upon rotation of the rotary hook drive motor 58, the hook shaft 60 is rotated through the drive shaft 58*a* and the coupling 61, so that the rotary hook 59 is rotated in a predetermined direction at a rotation speed K twice as high as a rotation speed of the spindle 17. A protection cover 66 is provided at the front end of the bed unit 10. The protection cover 66 is pivotally connected to the front lower end of the bed case 50, so that the protection cover 66 can be opened or closed.

Next, a supporting arrangement for position changeably supporting the rotary hook 59 in the frontward/backward direction will be described with reference to FIGS. 4 and 5. The attachment block 56 has a cylindrical portion in which a cylindrical bearing case 70 is disposed slidably in frontward/backward direction. A bearing 71 is force-fitted within the bearing case 70. The attachment block 56 has a left side wall to which an eccentric pin 72 is attached. The bearing case 70 has a left side wall formed with a vertically elongated pin slot, and a pin portion of the eccentric pin 72 is engaged with the pin slot. On the other hand, the attachment block 56 has a right side wall in which a set screw 73 is detachably provided for fixing the bearing case 70 to the attachment block 56.

With this arrangement, after the set screw 73 is unfastened, the eccentric pin 72 is rotated in one or opposite direction, so that the bearing case 70 is moved frontwardly or rearwardly by a minute distance, for example from 1 to 2 mm, because of the engagement between the eccentric pin 72 and the pin slot. Thus, position of the rotary hook 59 is finely controlled in the frontward or rearward direction for controlling a needle and rotary hook clearance.

Next, a thread cutting mechanism 80 will be described with reference to FIGS. 3 through 7. This mechanism is provided in each of the bed units 10, 11, 12 for cutting the needle thread 47 and a bobbin thread 48.

A fixed plate (not shown) is fixed to the attachment block 56, and extends above the rotary hook 59. A movable blade 81 is movably supported to the fixed plate. The movable blade 81 is pivotable between a stand-by position shown by a solid line in FIG. 7 and a maximum pivot position shown by a two dotted chain line. The movable blade 81 has an engaging portion 81*a*. A stationary blade 82 is provided below the throat plate 52 positioned immediately above the fixed plate. The stationary blade 82 has a blade edge orienting frontwardly for cutting the needle thread 47 and bobbin thread 48 in cooperation with the movable blade 81.

A thread cutting operation lever 83 is pivotally connected to the movable blade 81 and extends rearwardly in the bed case 50. That is, upon frontward movement of the thread cutting operation lever 83, the movable blade 81 is pivotally moved in a clockwise direction in FIG. 7 to the maximum pivot position indicated by the two dotted chain line. Then, the thread cutting operation lever 83 is moved rearwardly, so that the movable blade 81 is pivotally moved in a counterclockwise direction. During this counterclockwise movement, the needle thread 47 and the bobbin thread 48 are trapped by the engaging portion 81a of the movable blade 81, and then, these threads 47 and 48 are cut simultaneously by the movable and stationary blades 81 and 82.

Figure 8:
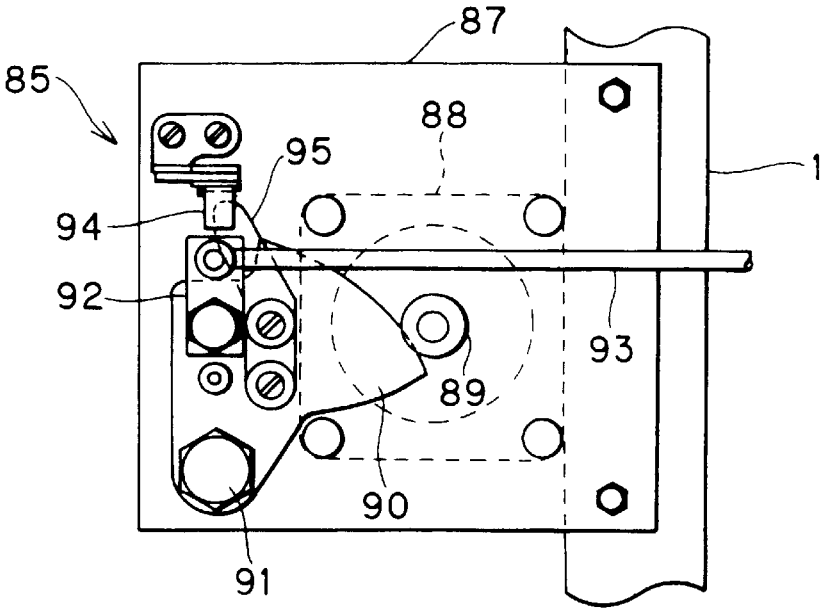
FIG. 8 is an enlarged plan view showing a thread cut driving mechanism according to the embodiment.

A thread cutting driving mechanism 85 for driving the thread cutting mechanism 80 will next be described with reference to FIGS. 3 and 8. A pivot lever 86 having an L-shape configuration in plan view is supported pivotally movably in a horizontal plane on a rear end portion of the bed case 50. The pivot lever 86 has a driven portion 86a to which a rear end of the thread cut operation lever 83 is pivotally connected. At the left end portion of the base frame 1, an attachment plate 87 is fixed, and a thread cutting motor 88 having a drive gear 89 is fixed to a bottom surface of the attachment plate 87. Further, a sector gear 90 meshingly engageable with the drive gear 89 is pivotally movably supported to the attachment plate 87 by a stepped bolt 91. To the sector gear 90, a base end portion of a plate like linking plate 92 is fixed whose tip end portion is linked with a left end portion of a thread cutting operation shaft 93 extending in the transverse direction of the frame 1. The pivot lever 86 has a drive portion 86*b* to which the thread cutting operation shaft 93 is connected.

Figure 7:
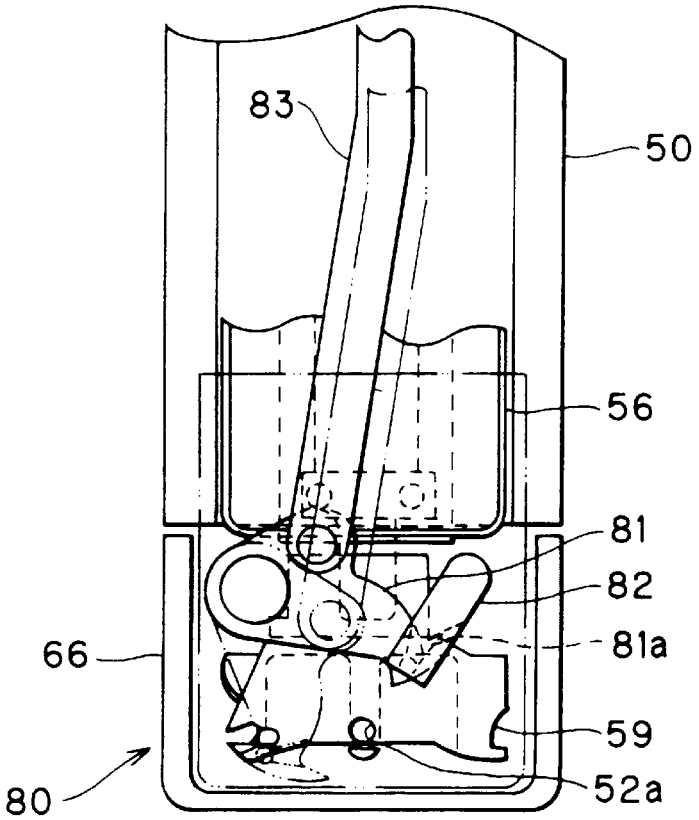
FIG. 7 is an enlarged plan view showing a front portion of the bed unit according to the embodiment.

If the thread cutting motor 88 is rotated in the counterclockwise direction, the sector gear 90 is angularly moved by a predetermined angle in the clockwise direction (FIG. 8), so that the thread cutting operation shaft 93 is moved in its axial direction rightwardly through the linking plate 92. Accordingly, the pivot lever 86 is pivotally moved in the clockwise direction to move the thread cut operation lever 83 frontwardly. Consequently, the movable blade 81 is moved to its maximum pivot position (FIG. 7).

Then, the thread cutting motor 88 is rotated in the clockwise direction to move the thread cut operation shaft 93 leftwardly, so that the pivot lever 86 is pivotally moved in the counterclockwise direction for moving the thread cut operation lever 83 rearwardly. Consequently, the needle thread 47 and the bobbin thread 48 which have been engaged with the movable blade 81 are cut simultaneously in cooperation with the stationary blade 82 as described above.

The attachment plate 87 is provided with a moving position detecting sensor 94 such as a photosensor at a position adjacent to the sector gear 90. Further, the sector gear 90 is provided with a shield plate 95 for shielding the position detecting sensor 94 to render the latter ON. That is, if the movable blade 81 is moved to a position outside of its cutting position, the moving position detection sensor 94 does not detect the shield plate 95, so that the sensor 94 generates "L" level moving position detection signal DS. On the other hand, if the movable blade 81 restores its cutting position, the shield plate 95 is aligned with the sensor 94, so that the sensor 94 generates "H" level moving position detection signal DS (thread cutting signal).

A control system for the multiple head type embroidery machine M will next be described with reference to a block diagram shown in FIG. 9. A first control device 100 and a second control device 150 are provided. The first control device or a sewing machine control device 100 is adapted for controlling entire embroidery machine M except the control to the driving mode of the rotary hook 59 and a thread cutting control.

The sewing machine control device 100 is provided with a microcomputer including a CPU 101, a ROM 102 and a RAM 103, and input and output interfaces (not shown) connected to the microcomputer through data bus. The RAM 103 stores therein embroidery data as a stitching program.

To the sewing machine control device 100, are connected, with respect to the head portion 4, a driver circuit 105 connected to the needle bar jumping solenoid 41, a driver circuit 107 connected to a pressure foot driving solenoid 106, and a thread cutting sensor 108. A conventional thread cutting sensor 108 is available which includes a rotation member rotatable by frictional contact with the paid out needle thread, and a photosensor for detecting the rotation state of the rotation member. Judgment of the thread cutting can be made by detecting non-rotation of the rotation member in spite of a predetermined vertical reciprocating numbers of the sewing needle 2.

A driver circuit 111 connected to the sewing machine motor 110 is connected to the sewing machine control device 100. The sewing machine motor 110 has a disc encoder. A first encoder sensor 112 is also connected to the sewing machine control device 100. The first encoder sensor 112 generates a thousand slit signals or spindle rotation signals upon a single rotation of the disc encoder. A point of origin sensor 113 is also connected to the sewing machine control device 100 for generating a single signal indicative of a point of origin of the spindle 17 upon a single rotation of the first encoder sensor 112. A stop position sensor 114 is connected to the control device 100 for detecting a stop position of the needle bar 21, i. e., at a rotation angle of 100° of the spindle 17. A driver circuit 116 connected to a needle bar changing motor 115 is connected to the control device 100 for moving the needle bar case 20 and changing the needle bar 21 with another needle bar (see FIG. 2). Further, to the sewing machine control device 100, are connected a driver circuit 118 connected to the X-axis drive motor 117, a driver circuit 120 connected to the Y-axis drive motor 119, and the operation panel 18 provided with the display 18a and various switches (not shown) for starting stitching operation and inputting various command signals.

The second control device or hook shaft driving control device 150 is connected to the sewing machine control device 100 for controlling the rotary hook 59 and thread cutting operation. The hook shaft driving control device 150 is provided with a microcomputer including a CPU 151, a ROM 152 and a RAM 153, and input and output interfaces (not shown) connected to the microcomputer through data bus. Regarding the bed unit 10, the rotary hook drive motor 58 (FIG. 4) is connected to the control device 150 through a driver circuit 154, and the second encoder sensor 65 (also shown in FIG. 4) and a hook shaft point of origin sensor 155 are also connected to the control device 150. The second encoder sensor 65 is adapted to generate fifty slit signals (hook shaft rotation signal) upon a single rotation of the disc encoder 64 (FIG. 4) connected to the rotary hook drive motor 58. The point of origin sensor 155 is adapted to generate a single synchronization signal of the hook shaft upon a single rotation of the disc encoder 64. The other bed units 11, 12 also provide the control system identical with the above described arrangement. Further, the moving position detection sensor 94 and a driver circuit 156 connected to the thread cutting motor 88 (FIGS. 3 and 9) are connected to the hook shaft control device 150.

An induction motor is available as the sewing machine motor 110 which is subjected to an inverter control. The 1000 slit signals (spindle rotation signals) transmitted from the first encoder sensor 112 by the single rotation of the disc encoder provided to the sewing machine motor 110 are subdivided into 4000 pulses which are used as the spindle control pulses for controlling the motor. On the other hand, a stepping motor is available as the rotary hook drive motor 58, and is rotated by 360° upon receipt of 500 pulses, and simultaneously, the rotary hook 59 is also rotated by 360°. The rotary hook drive motor 58 is subjected to velocity doubling control in such a manner that the rotary hook drive motor 58 is rotated twice during single rotation of the spindle 17.

A parameter setting process for setting parameters in association with the respective sewing needles will next be described with reference to a flowchart shown in FIG. 10. The parameter setting process will be executed by pushing down the parameter setting key (not shown) provided in the operation panel 18.

First, a needle counter is initialized to 1 (S200). Next, the user inputs the number of needles using keys (not shown) provided on the operation panel 18, and the inputted number is stored in the RAM 103 (S201). Then, the value of the needle counter is compared to the number of needles stored in the RAM 103 to determine whether or not parameters for all of the needles have been entered (S202). If the value of the needle counter is equal to the number of needles stored in the RAM 103, then the setting process is determined complete ("Yes" in S202), and the process is ended.

On the other hand, if the value of the needle counter is not equal to the number of needles, indicating that the process is not finished ("No" in S202), the process waits for the user to input parameter values for the needle indicated by the needle counter (S203). Parameter values are input using keys provided on the operation panel 18. The inputted values are stored in the RAM 103 in a table structure to be described later. Next, the needle counter is incremented by 1 (S204), and the process returns to S202.

Figures 10, 11:
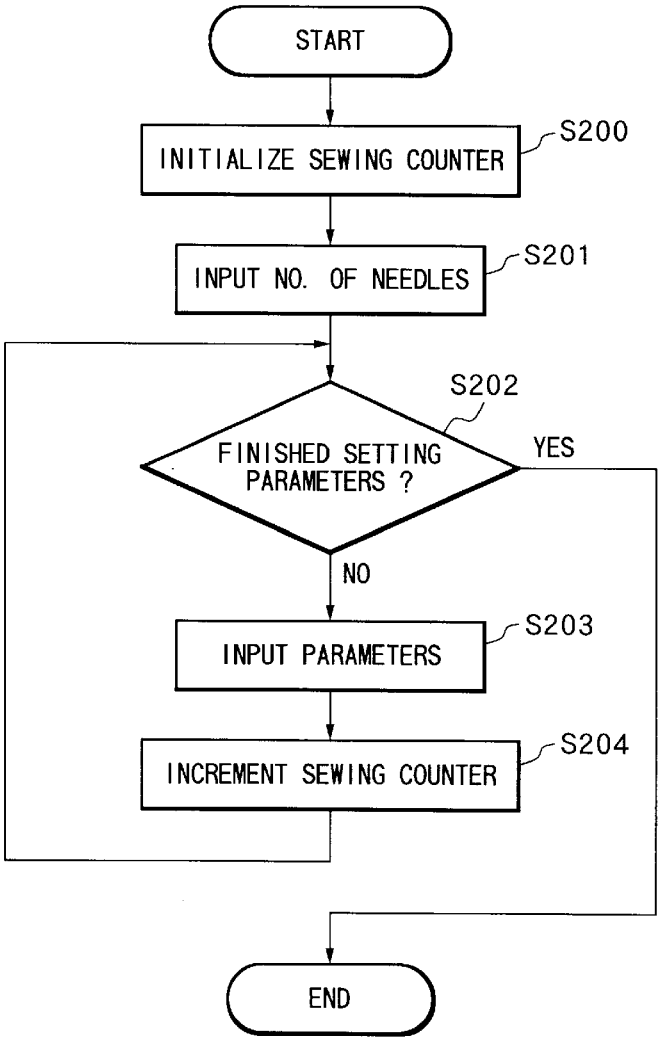
FIG. 10 is a flowchart showing a parameter setting routine according to the embodiment.
FIG. 11 is an example for various parameters set with respect to each sewing needles according to the embodiment.

According to the process described above, a parameter table like the one shown in FIG. 11 is created in the RAM 103 of the sewing machine control device 100. To simplify the table, parameters for only four of the needles are shown in FIG. 11. However, the multiple head type embroidery machine M has twelve needles 22. Therefore, the parameter table actually contains parameters for twelve sewing needles.

The Maximum Sewing Speed parameter in this table denotes the revolutions per minute (r.p.m.) of the sewing machine spindle 17. Hence, in the case of sewing needle 1, the spindle 17 is driven to rotate within a range not exceeding 1000 r.p.m.

The Thread Cutting (or breakage) Sensitivity parameter indicates the number of stitches to continue sewing after the thread cutting sensor 108 ceases to detect needle thread being paid out. In the case of sewing needle 1, it is assumed that a break in thread has occurred if the thread cutting sensor 108 does not detect the paying out of needle thread during a period of sewing five stitches.

Figure 15:
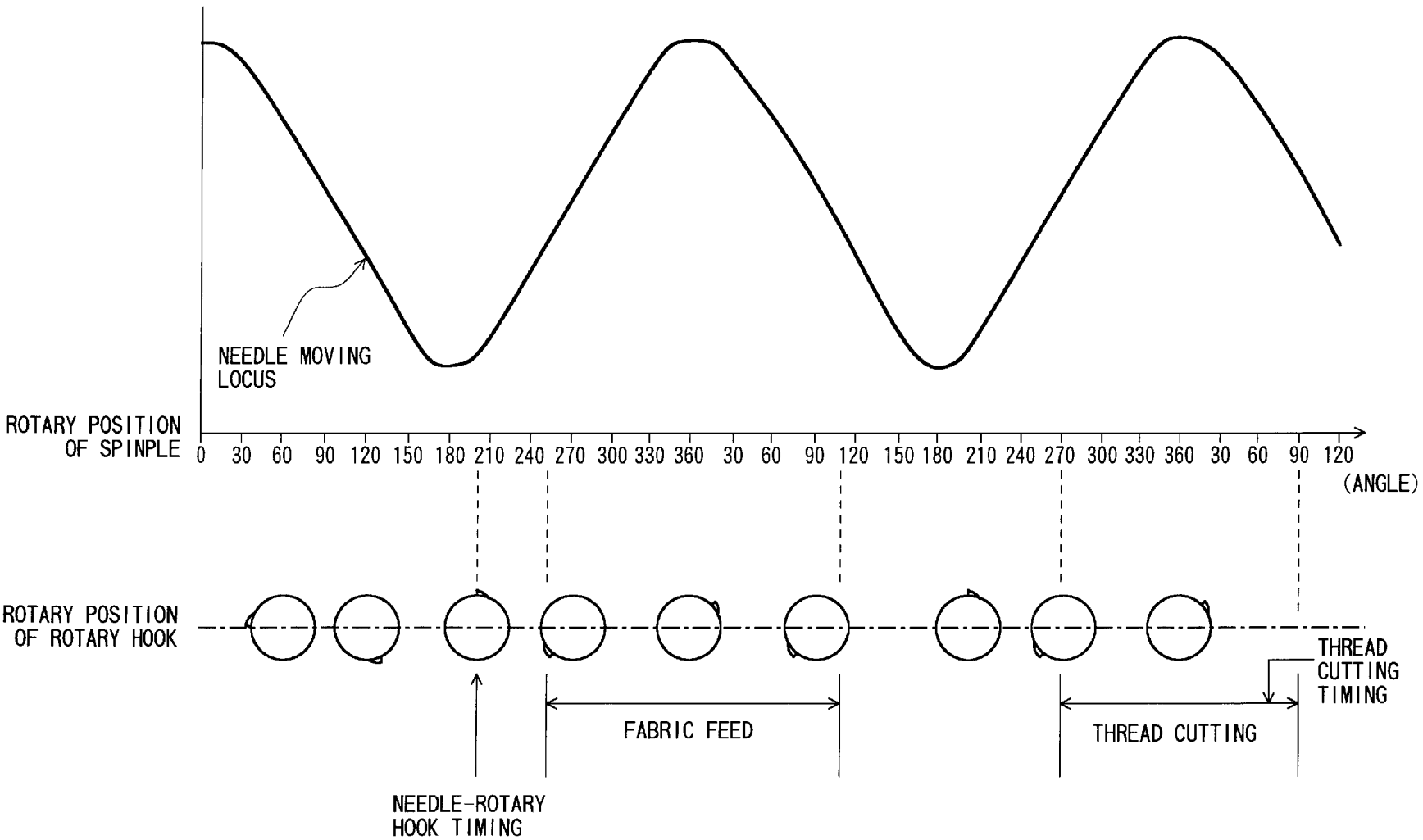
FIG. 15 is a view for description of a relationship among moving loci of a needle, rotation angle of a spindle, rotating position of a rotary hook, the needle and rotary hook meet position, fabric feed start and end timings, and thread cutting start and end timing according to the embodiment.

The Residual Thread Length parameter specifies according to a scale from 1 to 10 the interval timing for operating the thread cutting mechanism 80. The relationship between the rotational angle of the spindle 17 and the start timing for operating the thread cutting mechanism 80 is preset based on this level from 1 to 10. Normally, the thread cutting mechanism 80 begins operating when the spindle 17 has rotated about 270° and stops operating when the spindle 17 is at about 90°, as shown in FIG. 15. However, this phase from the beginning of operations to the end is shifted by a predetermined angular amount. The amount of thread leftover after the thread is cut varies according to differences in the start time for operating the thread cutting mechanism 80. However, since the actual amount of thread leftover also varies according to the stretchability and tensile strength of the thread, giving specific values to the levels 1 through 10 does not guarantee the residual amount of thread will be of specific lengths.

The Angle of Needle-Rotary hook Meet Angle parameter specifies within a range of −5° to +5° the rotational phase shift with respect to the standard rotational phase of the rotary hook 59. Normally, the rotary hook 59 reaches the meeting position when the spindle 17 is at about 200°, as shown in FIG. 15. However, with sewing needle 2, for example, the rotary hook 59 reaches the meeting position when the spindle 17 is at about 202°.

The Feed Timing parameter sets within a range of −5° to +5° the timing for operating the X-axis drive motor 117 and the Y-axis drive motor 119 which constitute the workpiece fabric feed mechanism. Normally, the workpiece fabric feed operation begins when the spindle 17, is at about 250° and ends when the spindle 17 is at about 110°, as shown in FIG. 15. However, with sewing needle 3, for example, the workpiece fabric feed operation begins when the spindle 17 is at about 248° and ends when the spindle 17 is at about 108°.

The Feed Pitch parameter is used to modify the driving amount for the X-axis drive motor 117 and the Y-axis drive motor 119. If the coordinates of three consecutive needle locations are represented by P1 (x1, y1), P2 (x2, y2), and P3 (x3, y3) in a coordinate system having units of millimeters, the coordinates of P2 are modified in the following way, based on the positional relationship of the three points. Assuming the Feed Pitch parameter is the value "a", and if x1<x2 and x3<x2, then x2 is modified to (x2+0.1×a). If x2<x1 and x2<x3, then x2 is modified to (x2−0.1×a). At the same time, if y1<y2 and Y3<y2, then y2 is modified to (y2+0.2×a). If y2<y1 and y2<y3, then y2 is modified to (y2−0.2×a). When performing these modifications, if the needle locations are in positions projecting in either the X direction (horizontal direction) or the Y direction (vertical direction), the amount of projection is increased a distance of just 0.1 mm in the X direction or just 0.2 mm in the Y direction provided that a =1. Therefore, when sewing an embroidery pattern, the edges of the pattern are emphasized more than usual.

Further, although the above parameter values stored in the parameter table include the meanings described above, the above parameters are converted to values appropriate for use in internal processing and stored in a memory in order to facilitate quick internal processing.

In using the multiple head type embroidery machine M, a separately provided personal computer (not shown) is connected to the sewing machine M via a communication interface device. For this reason, the parameter setting process shown in figure can be performed from the personal computer. After setting all the parameters from the personal computer according to the process in FIG. 10, the multiple head type embroidery machine M performs a process to receive the parameters from the personal computer via the communication interface device. In this way, a parameter table similar to the example shown in FIG. 11 can be created in the RAM 103 of the sewing machine control device 100. With this arrangement, the parameter setting process can be performed on the personal computer at the same time the multiple head type embroidery machine M is performing a different process. Then after the sewing machine M has completed the other process, parameters that have been updated on the personal computer can be quickly transferred to the sewing machine M, immediately completing preparations for the next sewing operation.

Figure 12:
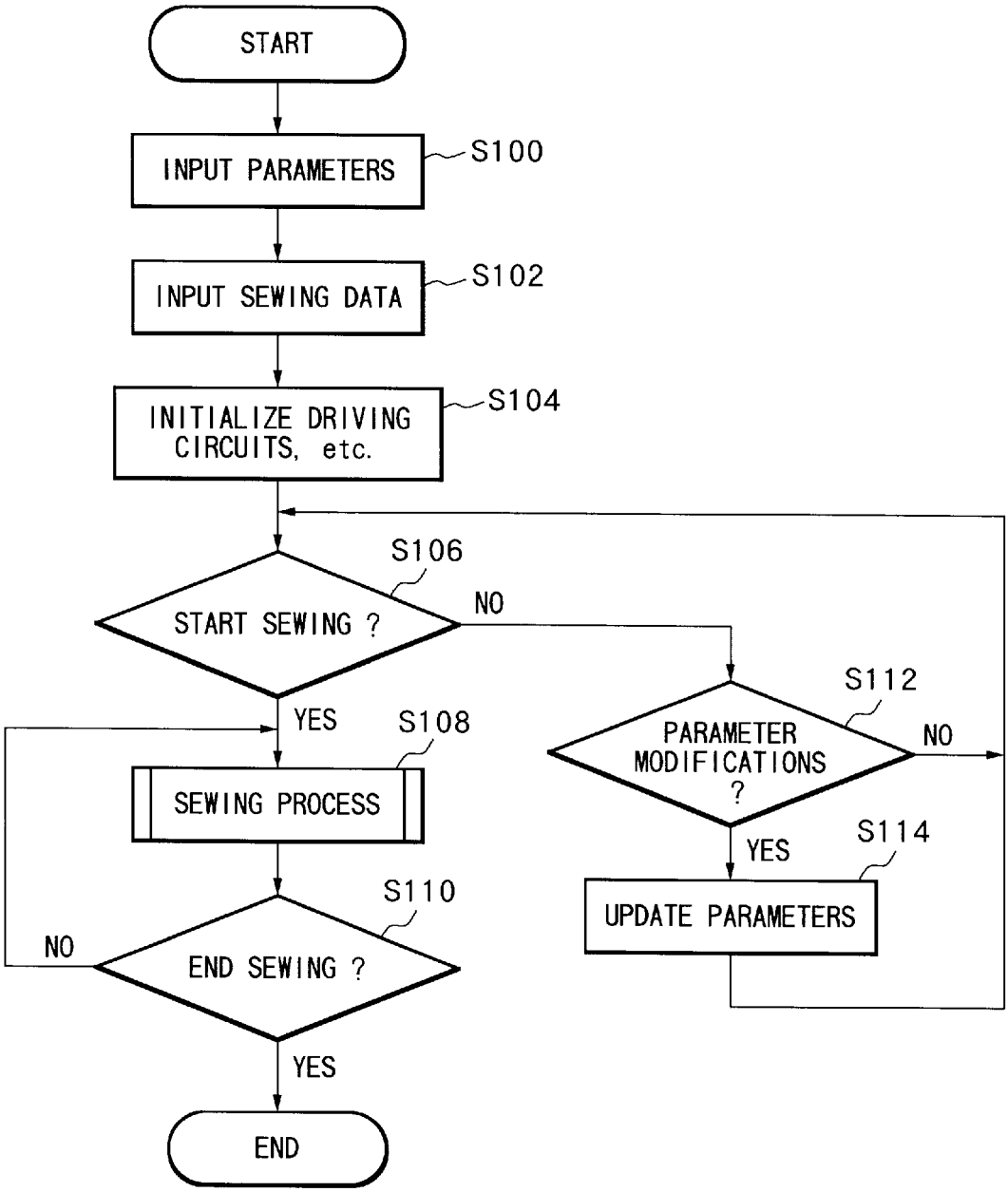
FIG. 12 is a flowchart showing an entire sewing control routine according to the embodiment.

Next, sewing operations of the multiple head type embroidery machine M will be described with reference to the flow-chart in FIG. 12. These operations begin when the start sewing key (not shown) on the operation panel 18 is pushed down.

First, the sewing machine control device 100 inputs parameters to be used as initial values of the parameter table (S100). More specifically, the parameter setting process of FIG. 10 described above can be executed with the multiple head type embroidery machine M and specified values are input using the operation panel 18. Alternatively, parameters can be received from a personal computer connected via a communication interface device. It is also possible to read previously created parameter data from a magnetic storage medium. In any case, the sewing machine control device 100 stores the input data in the RAM 103.

Figure 14:
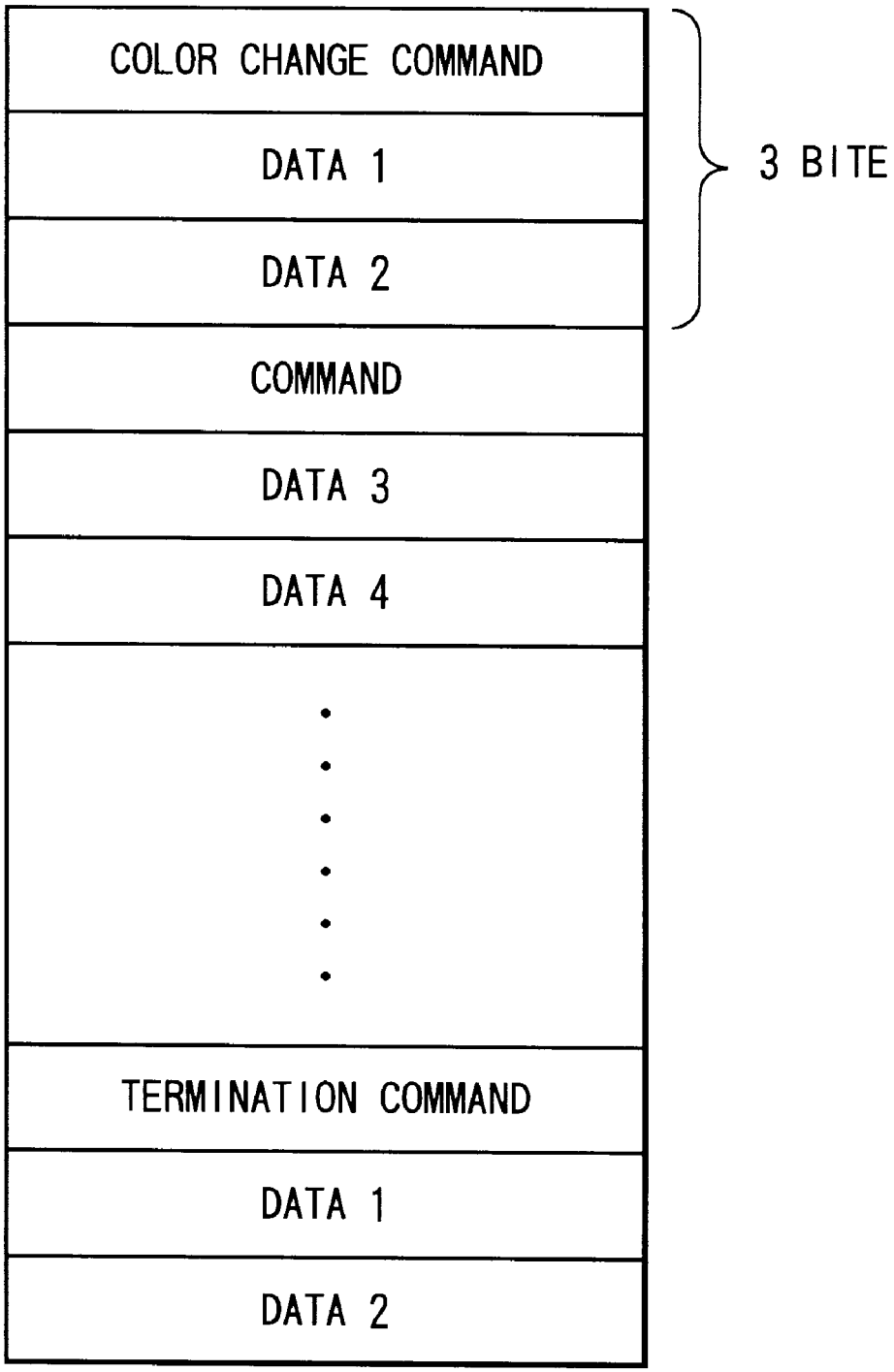
FIG. 14 is a view for description of sewing data construction according to the embodiment.

Next, the sewing machine control device 100 inputs sewing data (S102). In this description, the sewing data is received from the personal computer, but again it is also possible to read the sewing data from a magnetic storage medium. The sewing data is also stored in the RAM 103. As shown in FIG. 14, the input sewing data is in the form of a data array of non-specific length, wherein one unit of data consists of a one-byte command and two bytes of data. The first unit of the data array contains a Color Change command and is followed by a plurality of units containing other commands, such as a Cloth Feed command or a Switch Form command. The sewing data contains a plurality of similar groups, each having a Color Change command in the first unit followed by a plurality of units containing other commands. The last unit of the data array contains an End command.

The sewing machine control device 100 initializes driving circuits, such as the needle bar changing motor 115, the X-axis drive motor 117, and the Y-axis drive motor 119 (S104). A check is performed to determine if the start sewing key (not shown) on the operation panel 18 has been pushed (S106). If the start sewing key has been pushed ("Yes" in S106), the sewing process described later is started (S108) and is repeatedly performed as long as the sewing operation has not ended ("No" in S110). When the sewing operation is finished ("Yes" in S110), this process ends. The sewing operation is determined to be finished in S110 if an End command appears in the sewing data or if the end sewing key (not shown) on the operation panel 18 is pressed.

If the start sewing key has not been pushed in the process of S106, a check is performed to determine whether parameters are to be modified (S112). More specifically, since it is possible to modify parameters using the personal computer, as described above, parameters can be modified on the personal computer while the multiple head type embroidery machine M is executing the processes in S108 through S110. Therefore, polling is performed with respect to the personal computer and if new parameters are received ("Yes" in S112), the parameter table in the RAM 103 is updated (S114), and the process returns to S106. If new parameters are not received from the personal computer ("No" in S112), the process returns to S106 without updating the parameter table.

Next, the sewing process performed in S108 will be described with reference to a flowchart of FIG. 13. Each time the sewing process of S108 is executed, one unit (three bytes) of the above-described sewing data is processed.

When the sewing process begins, the sewing machine control device 100 verifies that the first byte of data is a Color Change command (S120). If the first byte of data is a Color Change command ("Yes" in S120), a check is made to determine whether a thread cut is necessary (S122). However, since the process has just begun and no sewing has been performed yet, a thread cut is unnecessary ("No" in S122). If the sewing has already begun, a thread cut is necessary for the purpose of changing a color of the thread ("Yes" in S122). In the latter case, the Residual Thread Length set for the sewing needle 22 currently in use is referenced in the parameter table. If the rotational angle of the spindle 17 corresponds to the beginning of the thread cut interval appropriate for the Residual Thread Length ("Yes" in S124), the thread cutting mechanism 80 is operated to cut the thread (S126). Although the thread cutting mechanism 80 begins to operate at the beginning of the thread cut interval, the process takes a certain amount of time period to complete, as shown in FIG. 15. The thread cut timing indicated in the drawing shows when the thread is actually cut during this thread cutting interval.

Next, the parameters corresponding to the sewing needle 22 specified by the Color Change command are selected (S128). More specifically, when the first byte of sewing data is a Color Change command, the second byte contains the number of the sewing needle used until now, and the third byte contains the number of the sewing needle to be used next. The RAM 103 contains a table pointer for indicating which data set in the parameter table corresponds to the sewing needle 22 currently in use. This table pointer is updated based on the needle number in the sewing data. Hence, the parameters are selected by setting the table pointer to point to the data set corresponding to the sewing needle 22 to be used next.

The needle bar changing motor 115 is driven to move the needle bar case 20, changing the sewing needle 22 with a needle specified by the sewing data (S130). The maximum sewing speed for sewing operations is changed according to the Maximum Sewing Speed parameter in the parameter table (S132), and the rotary hook 59 is synchronized to that speed (S134). At the same time the rotary hook 59 is synchronized in relation to the spindle 17, the Meeting Angle is referenced in the parameter table and the rotational phase is adjusted in relation to the standard rotational phase based on this Meeting Angle.

Before ending the process, the sewing data pointer is advanced one unit in order to process the next unit in the sewing data (S136). By completing the steps S120 through S136, the process for the Color Change command is complete.

However, if at the beginning of the process the first byte of sewing data is not a Color Change command ("No" in S120), a check is performed to determine whether the first byte of sewing data is an End command (S140).

If the first byte is not an End command ("No" in S140), then the sewing data is data used to form a stitch. Therefore, the feed position is modified based on the Feed Pitch in the parameter table (S142). Since the method for modifying the feed position is described above, a description will be omitted here.

Next, the process waits for the time interval until the movable frame 16 is moved based on the rotational angle of the spindle 17 and the Feed Timing in the parameter table. When the move interval begins ("Yes" in S144), the X-axis drive motor 117 and Y-axis drive motor 119 are driven to move the movable frame 16 (S146). A stitch is then formed through the combined operations of the sewing needle 22 and the rotary hook 59 (S148).

Next, a check is performed to determine if thread breakage has occurred based on signals from the thread cutting sensor 108 and the Thread Breakage Sensitivity parameter in the parameter table (S150). If thread breakage has not occurred ("No" in S150), the routine goes back to the step S136, and the sewing process is ended.

By performing the steps S140 through S150 described above, the process for a normal stitch command is completed. However, if thread breakage occurs ("Yes" in S150), the sewing process is immediately interrupted to perform steps S152 through S158. Here, the process waits until either the cancel sewing key or the resume sewing key on the operation panel 18 has been pushed ("No" in S152 and S154).

If the cancel sewing key is pushed "Yes" in S152), the current sewing process is immediately ended, canceling all subsequent sewing processes. However, if the user resets the thread and presses the resume sewing key "Yes" in S154), the stitch back number is computed based on the Thread Breakage Sensitivity in the parameter table (S156), so that the stitch back number is greater than the stitch number of the thread cutting sensitivity stored in the RAM. The sewing data pointer is set back an amount equal to the stitch back number (S158), and the process is ended.

By performing the steps S156 through S158, the next time the sewing process is executed, sewing will resume from the point in the sewing data to which the pointer was set back. Hence, a portion equal to the stitch back number will be sewn. Since the stitch back number is always a larger value than Thread Cutting Sensitivity regardless of the setting for the Thread Cutting Sensitivity, the sewing process will without fail be resumed from a point before the stitch at which the thread breakage occurred. That is, the portion unstitched due to the breakage of the thread can surely be stitched.

If in S140 the first byte of the sewing data is an End command ("Yes" in S140), the Residual Thread Length in the parameter table set for the sewing needle 22 currently in use is referenced, and when the thread cut interval corresponding to the Residual Thread Length begins ( "Yes" in S160), the thread cutting mechanism 80 is operated to cut the thread (S162), and the process is ended.

As described above, parameters specifying sewing operating conditions such as Maximum Sewing Speed, Thread Cutting Sensitivity, Residual Thread Length, Needle-Rotary Hook Meeting Angle, Feed Timing, and Feed Pitch are set to desirable values corresponding to each of the twelve needles 22. When performing the sewing process, parameters for the current sewing needle 22 are referenced in order to properly control the various parts of the sewing machine. Accordingly, adjusting the parameters for one of the sewing needles will not affect the sewing performance of the other needles. Even if the sewing needle 22 currently in use is changed by a Color Change command in the sewing data, the sewing operations will always be appropriate to the characteristics of the thread provided for the current sewing needle 22.

More specifically, even if the thread having high tenacity and the thread having low tenacity are co-used, high speed sewing can be performed with respect to the high tenacity thread to enhance sewing efficiency, whereas low speed sewing is performed with respect to the low tenacity thread to avoid thread breakage by setting the maximum stitch speed parameters with respect to each thread.

Further, in case of the thread capable of detection of its pay-out easily, the stitch numbers until the sewing is suspended can be set small so that the sewing operation can be promptly suspended after breakage of the thread. On the other hand, in case of the thread which is difficult to undergo detection of its pay-out, stitch numbers until the sewing operation is suspended is set large, so that the erroneous suspension of sewing can be avoided. This can be achieved by setting thread cutting sensitivity parameter for each thread.

Further, even if a non-shrinkable thread and easily shrinkable thread are co-used, thread cutting is performed at a proper timing capable of providing a proper residual length of the thread provided that the thread does not shrink after cutting with respect to the non-shrinkable thread, and thread cutting is performed at another proper timing capable of providing a sufficient residual length even after the shrinkage of the thread with respect to the shrinkable thread by setting the thread residual amount parameter for each thread.

Further, even if a thread which is easily trapped at early timing after the needle is moved past the lower dead center and a thread which can be trapped at relatively later timing after the needle is moved past its lower dead center are mixed together, these threads can be trapped by properly adjusting the rotation phase of the rotary hook for each thread by setting needle-rotary hook meet angle parameter for each thread.

Further, due to the difference in characteristic of the threads, even if a thread which is subjected to be loosely stitched into the workpiece and a thread which is subjected to be tightly stitched into the workpiece are co-used, feed timing is adjusted so that a tight stitch can be formed for the former thread, and a loose stitch can be formed for the latter thread by setting feed timing parameters for each thread.

Further, feed pitch parameters are set for respective threads in such a manner that a larger stitch than a standard stitch is formed with respect to a thread which visually provides a small stitch, and a smaller stitch than the standard stitch is formed with respect to a thread which visually provides a large stitch. Thus, visually uniform stitch size is obtainable regardless of the difference in color and diameter of the threads those being factors for providing the visual difference. Moreover, if the feed pitch is controlled in such a manner that an outer contour of the embroidery pattern can project outwardly, acute edge can be provided in the contour of the embroidery pattern.

While the invention has been described in detail and with reference to the specific embodiment thereof, it would be apparent to those skilled in the art that various changes and modifications may be made therein without departing from the spirit and scope of the invention. For example, with the multiple head embroidery sewing machine described above, the parameters of Maximum Sewing Speed, Thread Cutting Sensitivity, Residual Thread Length, Needle-Rotary hook Meet Angle, Feed Timing, and Feed Pitch are all set to desired values. However, depending on the objective and efficiency level of the sewing machine, it is possible to allow one or any number of the above parameters to be set to desired values.

Also, in the embodiment described above, the multiple head embroidery sewing machine is described as the multiple needle sewing machine. However, the present invention can also apply to other types of multiple needle sewing machines.

Further, in the depicted embodiment, residual thread length can be controlled by controlling the start timing of the thread cutting mechanism in conjunction with the engagement of the needle thread with the rotary hook. For example, long residual length of the needle thread can be provided by cutting the needle thread at a time when the needle thread is wound around the rotary hook, and a short residual length of the needle thread can be provided by cutting the needle thread at a time when the needle thread is disengaged from the rotary hook. However, it is not always necessary to control the start timing of the thread cutting mechanism for the purpose of controlling the residual thread length if other member such as a picker is employed. The picker is adapted for trapping the needle thread as disclosed in U. S. Pat. No. 3,709,176, and U.S. Pat. No. 4,077,342 which are incorporated by reference. Thus, residual length of the needle thread after cutting can also be controlled by controlling the thread trapping timing by the picker.

Further, various kinds of motors are available as the sewing machine motor 110 and the rotary hook drive motor 58 as far as the functions of the sewing machine are not lost. For example, a stepping motor is available as the sewing machine motor 110, and an AC servo motor is available as the rotary hook drive motor 58.

What is claimed is:

1. A sewing machine comprising:

a plurality of sewing needles having needle threads threaded therethrough, a selected one of the sewing needles being driven in accordance with a sewing program;

parameter setting means for setting a plurality of parameters each defining an operating condition of at least one sewing machine component, each parameter being set for each sewing needle, and each parameter being previously determined in accordance with kinds or characteristics of the needle threads;

parameter storage means for storing the parameters set by the parameter setting means for each sewing needle;

parameter selection means for selecting one of the parameters corresponding to the selected one of the sewing needles among the parameters in the parameter storage means; and sewing control means for controlling the at least one sewing machine component in order to perform a sewing operation based on the parameter selected by the parameter selection means.

2. The sewing machine as claimed in claim 1, wherein the plurality of parameters include a maximum sewing speed parameter, the sewing control means controlling sewing speed so that the sewing operation is performed within the maximum sewing speed for each of the sewing needles.

3. The sewing machine as claimed in claim 2, wherein the at least one sewing machine component comprises a sewing machine motor and a spindle rotationally driven by the sewing machine motor, the maximum sewing speed parameter being defined by the rotation of the spindle, the sewing control means controlling the sewing machine motor so that the sewing operation is performed within the maximum sewing speed for each of the sewing needles.

4. The sewing machine as claimed in claim 1, further comprising a plurality of thread spools each winding thereover the needle thread, and a thread cutting sensor for detecting pay-out of the thread from the thread spool;

and wherein the plurality of parameters include a thread cutting sensitivity parameter for each sewing needle, the thread cutting sensitivity parameter being indicative of stitch numbers for each sewing needle, the sewing control means stopping sewing operation if the thread pay-out from the thread spool has not been detected by the thread cutting sensor after the sewing has been performed according to the stitch numbers.

5. The sewing machine as claimed in claim 4, wherein the at least one sewing machine component comprises a sewing machine motor and a spindle rotationally driven by the sewing machine motor; the sewing control means stopping rotation of the sewing machine motor if the thread pay-out from the thread spool has not been detected by the thread cutting sensor after the sewing has been performed according to the stitch numbers.

6. The sewing machine as claimed in claim 4, further comprising means for computing stitch back numbers based on the stitch numbers so that a computed stitch back number becomes greater than the stitch numbers, the sewing control means controlling re-starting position of sewing based on the stitch back numbers, whereby an unstitched portion due to the thread breakage can undergo stitching in a re-starting phase of sewing.

7. The sewing machine as claimed in claim 1, wherein the at least one component comprises components of a thread cutting mechanism;

and wherein the plurality of parameters include a thread residual amount parameter for each sewing needle, the sewing control means controlling the thread cutting mechanism for cutting the thread based on the thread residual amount parameter.

8. The sewing machine as claimed in claim 7, wherein the sewing control means controls a start timing of the thread cutting mechanism.

9. The sewing machine as claimed in claim 7, wherein the at least one sewing machine component further comprising a sewing machine motor and a spindle rotationally driven by the sewing machine motor for vertically reciprocating the selected sewing needle;

and wherein the thread cutting mechanism comprises a thread cutting motor and a blade driven by the thread cutting motor for cutting the needle thread;

and wherein the thread residual amount parameter is indicative of rotation start timing of the thread cutting motor with respect to a rotational phase of the spindle, the sewing control means controlling a start timing of the thread cutting motor for cutting the thread based on the thread residual amount parameter.

10. The sewing machine as claimed in claim 1, wherein the at least one component comprises a rotary hook having a loop seizing beak for forming a thread loop;

and wherein the plurality of parameters include a needle-rotary hook meet angle parameter, the sewing control means controlling a rotation phase of the rotary hook for each sewing needle based on the needle-rotary hook meet angle parameter.

11. The sewing machine as claimed in claim 10, wherein the at least one component further comprises a sewing machine motor, a spindle rotationally driven by the sewing machine motor for vertically reciprocating the selected sewing needle, and a rotary hook drive motor connected to the rotary hook for drivingly rotating the rotary hook;

and wherein the needle-rotary hook meeting angle parameter is indicative of a shift of a rotation phase of the rotary hook with respect to the rotation of the spindle, the sewing control means controlling the rotary hook drive motor so that the rotation phase of the rotary hook relative to the spindle is shifted by the needle-rotary hook meeting angle parameter.

12. The sewing machine as claimed in claim 1, wherein the at least one component comprises components of a workpiece fabric feeding mechanism for feeding a workpiece fabric in a predetermined direction;

and wherein the plurality of parameters include a feed timing parameter defining a feed start and feed end timing of the workpiece fabric feeding mechanism, the sewing control means controlling feeding phase of the workpiece feeding mechanism for each sewing needle based on the feed timing parameter.

13. The sewing machine as claimed in claim 12, wherein the at least one component further comprises a sewing machine motor, and a spindle rotationally driven by the sewing machine motor for vertically reciprocating the selected sewing needle, and wherein the workpiece fabric feeding mechanism comprises a movable holder at which the workpiece fabric is held, an X-axis motor connected to the movable holder for moving the movable holder in X-direction, and a Y-axis motor connected to the movable holder for moving the movable holder in Y-direction;

and wherein the feed timing parameter is indicative of a shift of a rotation phase of at least one of the X-axis motor and the Y-axis motor with respect to the rotation phase of the spindle, the sewing control means controlling at least one of the X-axis motor and Y-axis motor so that the rotation phase of at least one of the X-axis motor and the Y-axis motor relative to the spindle is shifted by the feed timing parameter.

14. The sewing machine as claimed in claim 1, wherein the at least one component comprises a component of a workpiece fabric feeding mechanism for feeding a workpiece fabric in a predetermined direction;

and wherein the plurality of parameters include a feed pitch parameter defining a feed pitch of a workpiece fabric for each sewing needle, the sewing control means controlling feeding speed of the workpiece feeding mechanism with respect to each single stitch based on the feed pitch parameter.

15. The sewing machine as claimed in claim 14, wherein the workpiece fabric feeding mechanism comprises a movable holder at which the workpiece fabric is held, an X-axis motor connected to the movable holder for moving the movable holder in an X-direction, and a Y-axis motor connected to the movable holder for moving the movable holder in a Y-direction;

and wherein the feed pitch parameter is indicative of an increase or decrease in pitch length of each stitch, the sewing control means controlling at least one of the X-axis motor and Y-axis motor so that the driving amount of at least one of the X-axis motor and Y-axis motor is changed based on the feed pitch parameter.

16. The sewing machine as claimed in claim 1, further comprising means for modifying the parameters and updating the parameters to the modified parameters for storing the modified parameters in the parameter storage means.

17. The sewing machine as claimed in claim 1, further comprising:

a sewing machine frame accommodating therein the parameter storage means, the parameter selection means, and the sewing control means; and a personal computer disposed separate from the sewing machine frame and electrically connected thereto, the personal computer including the parameter setting means, whereby parameter setting operation can be performed independent of sewing operation.

18. The sewing machine as claimed in claim 17, further comprising:

means for updating the parameters for storing an updated parameters in the parameter storage means; and polling means for polling to the personal computer so as to check whether or not the parameter is modified by the parameter setting means and to retrieve a modified parameter into the updating means.

19. A sewing machine for stitching a workpiece fabric with a needle thread and a bobbin thread comprising:

a plurality of needle bars each securing a sewing needle, each sewing needle having threaded therethrough a needle thread different from other needle threads, each needle thread being paid out from a respective thread spool to each sewing needle;

a sewing machine motor;

a spindle rotatingly driven by the sewing machine motor;

means for connecting the spindle to a selected one of the needle bars so as to vertically reciprocatingly drive the selected needle bar carrying a desired needle thread;

a rotary hook having a loop seizing beak, a stitch being formed by cooperation of the sewing needle and the rotary hook;

a rotary hook drive motor for rotatingly driving the rotary hook, a thread cutting mechanism including a thread cutting motor and a blade driven by the thread cutting motor for cutting the needle thread and the bobbin thread;

a thread cutting sensor for detecting pay-out of the thread from a thread spool;

a workpiece fabric feeding mechanism including a movable holder at which the workpiece fabric is held, an X-axis motor connected to the movable holder for moving the movable holder in an X-direction and a Y-axis motor connected to the movable holder for moving the movable holder in a Y-direction;

parameter setting means for setting a plurality of parameters each defining an operating condition of at least one of the sewing machine motor, the rotary hook drive motor, the thread cutting motor, the X-axis motor and the Y-axis motor, each parameter being set for each sewing needle;

parameter storage means for storing the parameters set by the parameter setting means for each sewing needle;

parameter selection means for selecting one of the parameters corresponding to the selected one of the sewing needles among the parameters in the parameter storage means; and sewing control means for controlling the at least one of the sewing machine motor, the rotary hook drive motor, the thread cutting motor, the X-axis motor and the Y-axis motor in order to perform a sewing operation based on the parameter selected by the parameter selection means.

20. The sewing machine as claimed in claim 19, wherein the plurality of parameters comprise a maximum sewing speed parameter defining the rotation of the spindle, the sewing control means controlling the sewing machine motor based on the maximum sewing speed parameter so that the sewing operation is performed within the maximum sewing speed for each of the sewing needles.

21. The sewing machine as claimed in claim 20, wherein the plurality of parameters further comprise a thread cutting sensitivity parameter indicative of stitch numbers for each sewing needle, the sewing control means stopping the rotation of the sewing machine motor based on the thread cutting sensitivity parameter if the thread pay-out from the thread spool has not been detected by the thread cutting sensor after the sewing has been performed according to the stitch numbers.

22. The sewing machine as claimed in claim 21, wherein the plurality of parameters further comprise a thread residual amount parameter indicative of rotation start timing of the thread cutting motor with respect to a rotational phase of the spindle, the sewing control means controlling a start timing of the thread cutting motor for cutting the thread based on the thread residual amount parameter.

23. The sewing machine as claimed in claim 22, wherein the plurality of parameters further comprise a needle-rotary hook meet angle parameter indicative of a shift of a rotation phase of the rotary hook with respect to the rotation of the spindle, the sewing control means controlling the rotary hook drive motor so that the rotation phase of the rotary hook relative to the spindle is shifted by the needle-rotary hook meeting angle parameter.

24. The sewing machine as claimed in claim 23, wherein the plurality of parameters further comprise a feed timing parameter indicative of a shift of a rotation phase of at least one of the X-axis motor and the Y-axis motor with respect to the rotation phase of the spindle for defining a feed start and feed end timing of the movable holder, the sewing control means controlling at least one of the X-axis motor and the Y-axis motor so that the rotation phase of at least one of the X-axis motor and the Y-axis motor relative to the spindle is shifted by the feed timing parameter.

25. The sewing machine as claimed in claim 24, wherein the plurality of parameters further comprise a feed pitch parameter indicative of an increase or decrease in pitch length of each stitch, the sewing control means controlling at least one of the X-axis motor and the Y-axis motor so that the driving amount of at least one of the X-axis motor and the Y-axis motor is changed based on the feed pitch parameter.

26. A method for performing different sewing operations in accordance with a difference in kind of needle threads threaded through a plurality of sewing needles in a sewing machine having the plurality of sewing needles, the sewing needles being consecutively selected and operated for performing stitching with different kind of threads, the method comprising the steps of:

provisionally setting parameters inherent to each sewing needle, the parameters being in correspondence with the threads of the sewing needles and determined based on at least one of materials, diameters, standing manner, tenacity, shrinkability and friction coefficient of the needle threads;

storing the set parameters in a memory with correspondence being made between each parameter and each sewing needle;

making judgment as to which one of the sewing needles is to be operated for sewing;

selecting the parameters associated with the sewing needle to be operated from the memory; and performing a sewing operation and a thread cutting operation based on the selected parameters.

27. A sewing machine comprising:

a plurality of sewing needles having needle threads threaded therethrough, a selected one of the sewing needles being driven in accordance with a sewing program;

parameter setting means for setting a plurality of parameters each defining an operating condition of at least one sewing machine component, each parameter being set for each sewing needle, said plurality of parameters including at least one of a maximum stitching speed parameter, a thread cutting sensitivity parameter, a thread residual amount parameter, a needle-rotary hook meet angle parameter, a feed timing parameter and a feed pitch parameter;

parameter storage means for storing the parameters set by the parameter setting means for each sewing needle;

parameter selection means for selecting one of the parameters corresponding to the selected one of the sewing needles among the parameters in the parameter storage means; and sewing control means for controlling the at least one sewing machine component in order to perform a sewing operation based on the parameter selected by the parameter selection means.

* * * * *